US011565851B2

(12) United States Patent
Grella

(10) Patent No.: US 11,565,851 B2
(45) Date of Patent: Jan. 31, 2023

(54) UNIVERSAL HANDLE ATTACHMENT TOOL FOR MANIPULATING DIFFERENT CONTAINERS

(71) Applicant: Raytheon Company, Waltham, MA (US)

(72) Inventor: Joseph E. Grella, Shrewsbury, MA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 17/348,509

(22) Filed: Jun. 15, 2021

(65) Prior Publication Data

US 2021/0309416 A1 Oct. 7, 2021

Related U.S. Application Data

(62) Division of application No. 16/425,823, filed on May 29, 2019, now Pat. No. 11,034,485.

(51) Int. Cl.
*B25G 3/00* (2006.01)
*B65D 25/28* (2006.01)
(Continued)

(52) U.S. Cl.
CPC ..... *B65D 25/2805* (2013.01); *A45F 5/102* (2013.01); *B25G 1/06* (2013.01);
(Continued)

(58) Field of Classification Search
CPC ..... A47L 9/32; A01B 1/026; B65D 25/2805; B65D 25/2808; B65D 25/282;
(Continued)

(56) References Cited

U.S. PATENT DOCUMENTS 1,617,213 A 2/1927 Paugh
1,840,492 A 1/1932 Duggan
(Continued)

FOREIGN PATENT DOCUMENTS

DE 2645090 A1 4/1978
JP 2000-354547 A 12/2000
(Continued)

*Primary Examiner* — Chuck Y Mah

(57) ABSTRACT

A universal handle attachment tool comprises a body having a plurality of tool sides each having a container interface surface operable to engage a face of a particular container, and having a container handle interface slot operable to receive a handle of the container. The slot can comprise a keyed profile operable to interface and lock the handle attachment tool to the container. The container interface surface extends in opposing directions beyond the slot to facilitate distribution of one or more loads acting between the face of the container and the handle attachment tool to facilitate manipulation of the container. A container for storage of at least one object comprises a container body defined by a plurality of sidewalls, and a recessed portion formed a sidewall defining a recessed cavity. The container has a handle spanning the recessed cavity, whereby the recessed cavity facilitates clearance of at least one finger of a user upon grasping the handle.

5 Claims, 19 Drawing Sheets

(51) Int. Cl.

| | |
|---|---|
| ***A45F 5/10*** | (2006.01) |
| ***B25G 1/06*** | (2006.01) |
| ***B25G 1/10*** | (2006.01) |
| ***B65D 23/10*** | (2006.01) |
| *B65D 8/00* | (2006.01) |

(52) U.S. Cl.
CPC ..... *B25G 1/102* (2013.01); *B65D 23/102* (2013.01); *A45F 2005/1073* (2013.01); *B65D 15/22* (2013.01)

(58) Field of Classification Search
CPC ..... B65D 25/2826; A45F 5/102; A45F 2005/1073; B25G 1/06; B25G 1/10; B25G 1/102; B25G 1/002; B25G 3/00; B25G 3/02; B25G 3/04; B25F 5/006; B25F 5/026; Y10T 16/469; Y10T 16/476; Y10T 16/473; Y10T 16/4713
See application file for complete search history.

(56) References Cited

U.S. PATENT DOCUMENTS

| | | | | |
|---|---|---|---|---|
| 2,630,244 | A | 3/1953 | Brock | |
| 3,261,633 | A | 7/1966 | Sakuta | |
| 3,464,082 | A | 9/1969 | Friberg | |
| 4,048,471 | A | 9/1977 | Ours | |
| 4,158,464 | A | 6/1979 | Bowen et al. | |
| 4,613,271 | A | 9/1986 | Naab | |
| 4,643,326 | A | 2/1987 | Klingler | |
| 4,842,158 | A | 6/1989 | Reyes, Jr. | |
| 4,850,502 | A | 7/1989 | Davis | |
| 5,193,244 | A | 3/1993 | Meyers | |
| 5,203,471 | A | 4/1993 | Widman | |
| 5,303,445 | A | 4/1994 | Meyers | |
| 5,373,608 | A | 12/1994 | Welch | |
| 5,377,863 | A | 1/1995 | Widman | |
| 5,774,937 | A | 7/1998 | Caminos | |
| 5,788,298 | A | 8/1998 | Cheng | |
| 5,918,754 | A | 7/1999 | Lyons et al. | |
| 6,053,345 | A | 4/2000 | Jones | |
| 6,062,619 | A | 5/2000 | Clark, Jr. | |
| 6,102,458 | A | 8/2000 | Scace | |
| 6,179,143 | B1 | 1/2001 | Grob | |
| 6,588,064 | B2 | 7/2003 | Baum | |
| 6,658,701 | B1 | 12/2003 | DeHart et al. | |
| 6,666,132 | B2 | 12/2003 | Dodane | |
| 7,240,403 | B1 | 7/2007 | Richardson | |
| 7,837,165 | B2 | 11/2010 | Stone | |
| 8,353,423 | B2 * | 1/2013 | McIntyre | A47J 45/071 220/759 |
| 8,505,788 | B2 | 8/2013 | Thibault | |
| 8,561,835 | B2 | 10/2013 | Hansen | |
| 8,714,386 | B2 | 5/2014 | Sasaki et al. | |
| 8,851,234 | B2 | 10/2014 | Bachorski | |
| 9,565,973 | B2 | 2/2017 | Paul | |
| 9,597,924 | B2 * | 3/2017 | Bajuyo | B44D 3/14 |
| 9,637,930 | B2 | 5/2017 | Grudzien et al. | |
| 2004/0187265 | A1 | 9/2004 | Ho | |
| 2005/0015933 | A1 | 1/2005 | Hasegawa | |
| 2005/0145637 | A1 * | 7/2005 | Lin | A47J 45/071 220/759 |
| 2006/0067801 | A1 | 3/2006 | Van Bergen | |
| 2009/0106942 | A1 | 4/2009 | Dell'orfano | |
| 2010/0146738 | A1 | 6/2010 | Kunnath et al. | |
| 2011/0132919 | A1 * | 6/2011 | Takuski | A47J 45/071 220/759 |
| 2011/0173778 | A1 | 7/2011 | Wales | |
| 2012/0181762 | A1 | 7/2012 | Skijus et al. | |
| 2014/0166677 | A1 | 6/2014 | Flanagan-Kent et al. | |
| 2017/0043909 | A1 | 2/2017 | Nelson et al. | |
| 2017/0210162 | A1 | 7/2017 | Jacobson et al. | |
| 2018/0346240 | A1 | 12/2018 | Bradbury et al. | |

FOREIGN PATENT DOCUMENTS

| | | | |
|---|---|---|---|
| JP | 2001-219934 | A | 8/2001 |
| KR | 200474164 | Y1 | 9/2014 |
| NL | 8401707 | A | 4/1985 |

* cited by examiner

UNIVERSAL HANDLE ATTACHMENT TOOL FOR MANIPULATING DIFFERENT CONTAINERS

RELATED APPLICATION

This is a divisional application of U.S. application Ser. No. 16/425,823, filed May 29, 2019, entitled "Universal Handle Attachment Tool for Manipulating Different Containers", which is incorporated by reference in its entirety herein.

BACKGROUND

Oftentimes, handles of containers or bins are relatively small compared to the size of the container, which can prove problematic for lifting the container via the handle, particularly when the container and the contents therein are relatively heavy. Said another way, the handle is not always sufficiently large enough, or shaped appropriately, to counteract the weight of a loaded container or bin. This can cause fatigue for users' hand(s) and arm(s) when transporting the container, and can also pose a risk of dropping the container and the contents therein, which can cause injury and/or generate foreign object debris (FOD) about a particular worksite. If the container is dropped and the contents are scattered about, this can increase production time for assembly of a particular product.

For instance, AutoCrib® markets and sells container dispenser or vending machines that can be put into use within a workplace, and that comprise a variety of pie-shaped containers or bins for storing contents, such as parts, fasteners, etc. used for assembly of a variety of products. One such container or bin is shown in FIGS. 1B (and 8A and 9A), and is further discussed below. The handle (e.g., 116) of such container, as provided by AutoCrib®, is typically insufficient to counteract the weight of such container when loaded with components or objects. This is not necessarily because of poor design of the handle and the container; rather, it is because of the limited amount of space or clearance provided by the container dispenser or vending machine. Such clearance issues require the container to have a very small handle (e.g., 116) that barely extends outwardly from the container, as illustrated by the container of FIG. 1B. Thus, engaging such small handle to lift and move the container can result in the aforementioned problems or concerns.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1A:
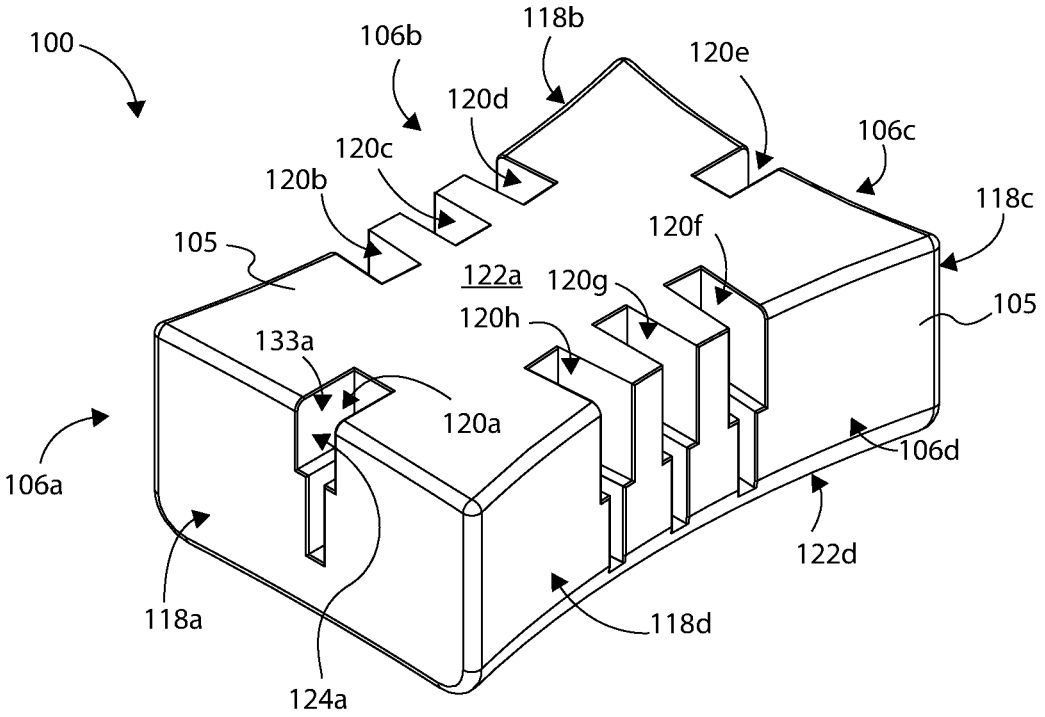
FIG. 1A is an isometric view of a universal handle attachment tool, in accordance with an example of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

The present disclosure sets forth a handle attachment tool operable to engage a container to facilitate manipulation of the container. The handle attachment tool can comprise a body shaped and sized to be grasped by a user, and the body can comprise a container interface surface operable to engage a face of the container, and a container handle interface slot formed through the container interface surface of the body. The container handle interface slot can be operable to receive a handle of the container, and the container handle interface slot can comprise a keyed profile defined by a plurality of slot surfaces oriented in different directions, and operable to interface with the handle of the container. The keyed profile is operable to lock the handle attachment tool to the container. The container interface surface extends in opposing directions beyond the container handle interface slot to facilitate distribution of one or more loads acting between the face of the container and the handle attachment tool to facilitate manipulation of the container.

The present disclosure sets forth a universal handle attachment tool operable to engage different sizes of containers to facilitate manipulation of respective containers. The universal handle attachment tool can comprise a body shaped and sized to be grasped by a user, and the body can comprise a first tool side and a second tool side. Each tool side can comprise a container interface surface operable to engage a face of a container, and a container handle interface slot formed through the container interface surface, and operable to receive a handle of the container. The container handle interface slot can comprise a keyed profile defined by a plurality of slot surfaces oriented in different directions, and can be operable interface with the handle of the container. The keyed profile is operable to lock the handle attachment tool to the container. The container interface surface of the first tool side can have a surface configuration different than a surface configuration of the container interface surface of the second tool side, such that the first and second tool sides are operable with different containers to facilitate manipulation of the respective containers.

The present disclosure sets forth a system for manipulation of a container with a handle attachment tool. The system can comprise a first container comprising a base, a plurality of sidewalls extending upward from the base (a first of the plurality of sidewalls comprising a face), an interior volume for supporting at least one object (the interior volume defined, at least in part, by the base and the plurality of sidewalls), and a handle formed outwardly from the face. The system can comprise a handle attachment tool comprising a body having a first container interface surface, and a slot formed through the first container interface surface and comprising a keyed profile shaped and sized to receive the handle of the first container. In response to interfacing the first container interface surface of the handle attachment tool with the front face of the first container and then upwardly moving the handle attachment tool relative to the first container, the keyed profile receives and interfaces with the handle of the first container to lock the handle attachment tool to the first container.

The present disclosure sets forth a container for storage of at least one object comprising a container body for receiving and supporting at least one object. The container body can comprise a base, a plurality of sidewalls extending upward from the base, an interior volume defined, at least in part, by the base and the plurality of sidewalls, a recessed portion formed through a first of the plurality of sidewalls (the recessed portion extending inward from a face of the first sidewall, and defining a recessed cavity), and a handle supported by the first sidewall and extending outward from the face of the first sidewall (the handle spanning the recessed cavity). Thus, the handle provides a user interface, and the recessed cavity facilitates clearance of at least one finger of a user upon grasping the handle.

Figure 1B:
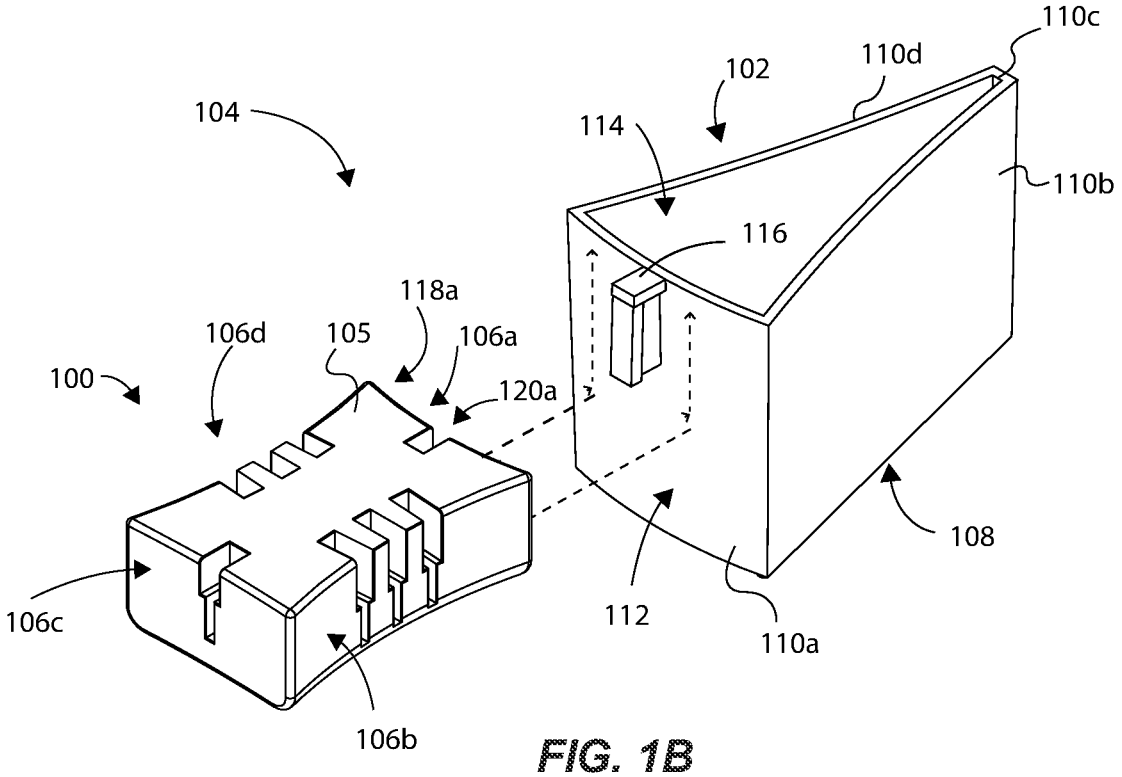
FIG. 1B is an isometric view of the universal handle attachment tool of FIG. 1A, and having a first tool side ready for engagement to a first container to lock the universal handle attachment tool to the first container.
Figure 3:
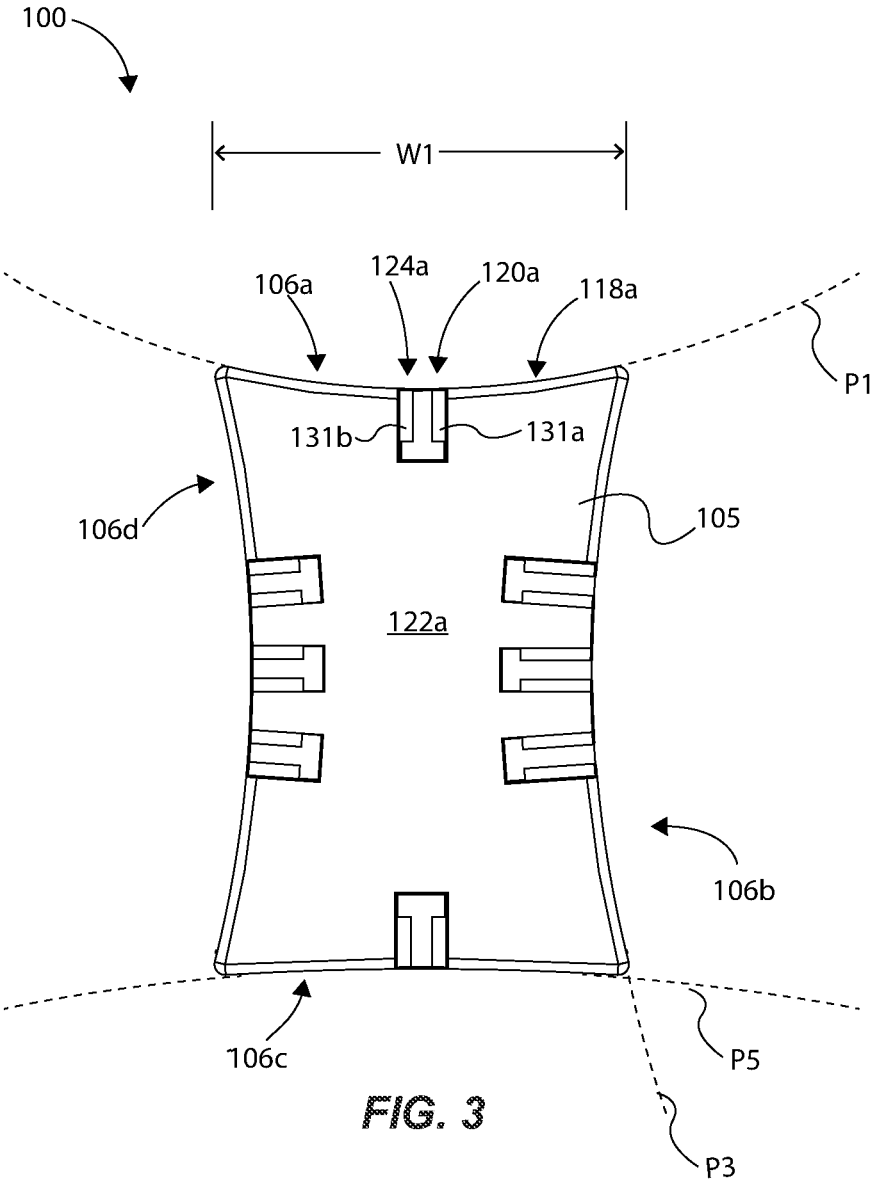
FIG. 3 is a top view of the universal handle attachment tool of FIG. 1A.
Figure 4:
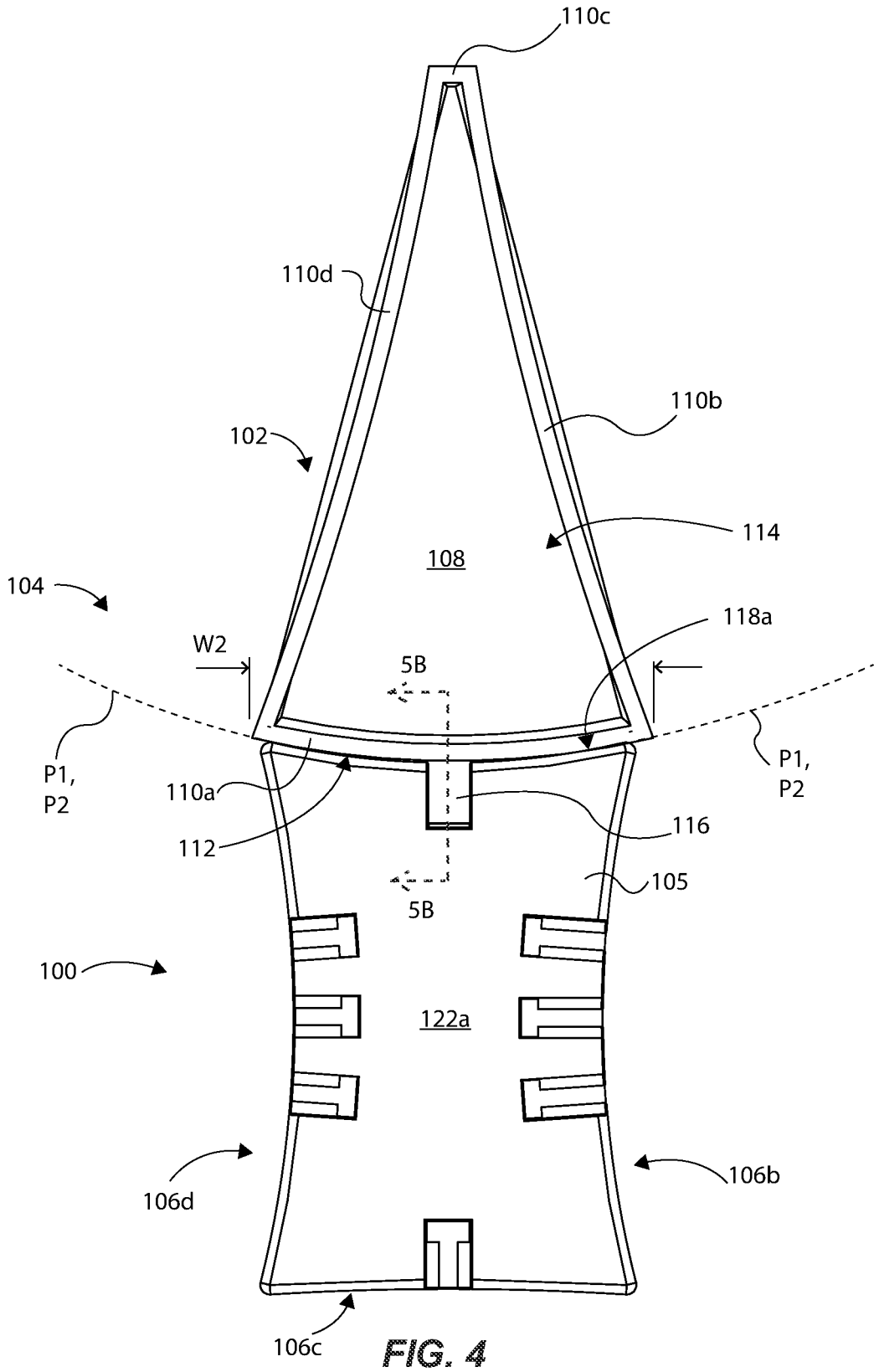
FIG. 4 is a top view of the universal handle attachment tool of FIG. 1A, showing the first tool side engaged with the first container shown in FIG. 1B.

To further describe the present technology, examples are now provided with reference to the figures. With reference to FIGS. 1A-7C illustrated are various aspects of a universal handle attachment tool 100 operable to engage bin or container 102 (e.g., could be an existing bin or container) to facilitate manipulation (e.g., lifting and moving) of the container 102, in accordance with an example of the present disclosure. In one example, a system 104 can comprise the universal handle attachment tool 100 and the container 102 for manipulation of the container 102 with the handle attachment tool 100 (e.g., as illustrated in FIGS. 1B and 4).

As an overview, the handle attachment tool 100 can comprise a body 105 shaped and sized to be grasped and moved by a user. The body 105 can comprise a plurality of tool sides 106*a-d* each operable with different sizes and/or types of containers for engaging with and moving the particular container (see e.g., the containers of FIGS. 1B, 8A, and 9A). For instance, as noted above regarding the products provided by AutoCrib®, the container 102 can be an existing or traditional bin or container usable with a container dispenser assembly (see e.g., FIG. 10) that operates to support a plurality of containers of different sizes, and operable to provide a particular container to a user for removal of the container from the container dispenser assembly. Thus, a particular container dispenser assembly or vending machine can operate to rotate and move a selected container to a particular position so that the user can remove the container from the assembly/machine to then use the objects or contents supported inside the particular container.

Accordingly, the container 102 can comprise a base 108 (e.g., a bottom or lower panel), and a plurality of sidewalls 110*a-d* that extend upwardly from the base 108. A first sidewall 110*a* of the plurality of sidewalls 110*a-d* can comprise a face 112, such as a front face or front surface that may be exposed by a container dispenser assembly, for instance, when the container 102 is selected by a user for dispensing of the container 102. The container 102 can comprise an interior volume 114 defined, at least in part, by the base and the plurality of sidewalls 110*a-d* for supporting at least one object (e.g., parts, fasteners, components). The container 102 can further comprise a handle 116 formed outwardly from the face 112 of the container 102. The handle 116 can be integrally formed with the face 112, or it can be separately attached thereto. The handle 116 may be formed similarly as a traditional handle of a container sold by AutoCrib®, and therefore can have a T-shaped profile or cross sectional area for gripping by a user. In some instances, the container 102 may be used to support a relatively heavy load, such as 5 lbs. or more, of objects inside the inner volume, which makes is difficult for a user to grasp only the handle 116 to lift and transport the container 102 and the objects therein. This is because, in one example, the handle 116 may be relatively small, such as extending only ¼ or ½ of an inch outwardly from the face 112. This provides very little surface area for a user to grasp the handle 116. As a result, users sometimes drop the container 102 because the handle 116 is too small for a user to adequately grasp and support the weight of the container 102 and the objects therein, as also noted above.

To remedy the aforementioned problems regarding the handle 116 of the existing container 102, the handle attachment tool 100 of the present disclosure is configured and formed to interface with the container 102 by locking the handle 116 to the handle attachment tool 100. More particularly, a user can grasp the handle attachment tool 100, interface it to the face 112 of the container 102, and then slide the handle attachment tool 100 upwardly relative to the handle 116 to lock the handle 116 to the handle attachment tool 100, as illustrated by the dashed arrows in FIG. 1B. Then, the user can lift and move the container 102 via the handle attachment tool 100 to transport the container 102 in a safe, reliable manner without dropping the container 102 because of the handle attachment tool 100 effectively counteracts the weight of the container 102 and the objects therein, as further detailed below.

More specifically, the first tool side 106*a* of the handle attachment tool 100 can comprise a first container interface surface 118*a* operable to engage and interface with the face 112 of the container 102. The handle attachment tool 100 can further comprise a first container handle interface channel or slot 120*a* (or "first slot") formed through the container interface surface 118*a* of the body 105, and also formed through an upper surface 122*a* of the body 105. The first slot 120*a* can be shaped and sized to receive the handle 116 of the container 102. In this manner, the first slot 120*a* can comprise a keyed profile 124*a* operable to interface and receive the handle 116 of the container 102 when the user slides the tool 100 upwardly relative to the handle 116. Said another way, the keyed profile 124*a* can be sized and shaped to correspond to the size and shape of the handle 116, as further detailed below.

Figure 2A:
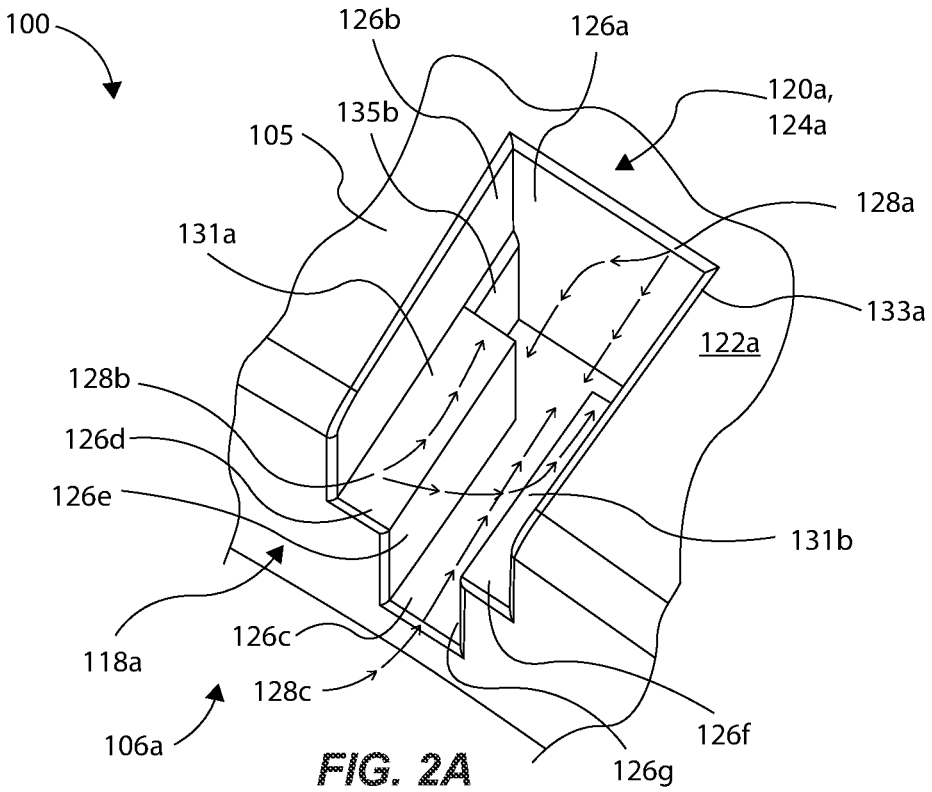
FIG. 2A is an isometric view of a slot, having a keyed profile, of the universal handle attachment tool of FIG. 1A.
Figure 2B:
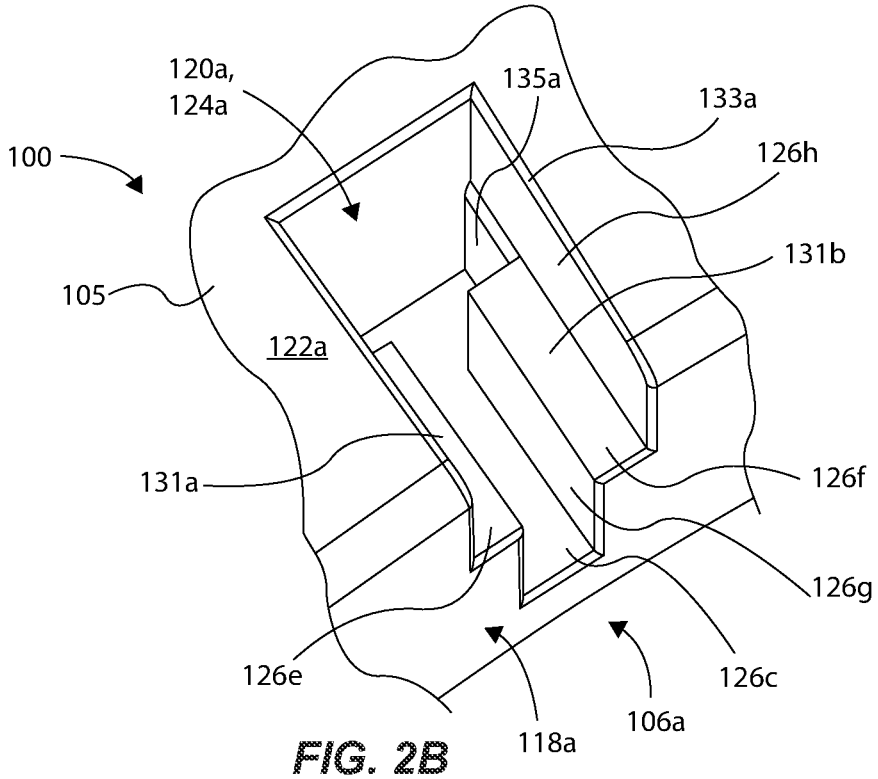
FIG. 2B is another perspective of the isometric view of the slot shown in FIG. 2A.

The first slot 120*a* can comprise a plurality of slot surfaces 126*a-g* that cooperate to engage and interface with the handle 116 to lock the handle attachment tool 100 to the container 102 (FIGS. 2A and 2B show details of the shape and size of the first slot 120*a*). At least some of the slot surfaces 126*a-g* can extend in different directions, and at least some of the slot surfaces 126*a-g* can extend orthogonally relative to each other. As shown, the slot surfaces 126*a-g* can be planar surfaces that extend ninety degrees relative to at least one adjacent slot surface. In other examples, the first slot 120*a* can alternatively be sized and shaped having a different keyed profile than the one illustrated, such as having irregular shaped slot surfaces, radial slot surfaces, or other slot surfaces that may correspond to the shape of a particular handle of a different container not illustrated herein. For instance, a container may have a handle having a triangular or round or other shaped portion that operates to interface and engage with a keyed profile of a handle attachment tool having a similarly shaped slot.

The keyed profile 124*a* can be further defined by a rear vertical slot volume 128*a*, an upper horizontal slot volume 128*b*, and a lower horizontal slot volume 128*c*, and each slot volume 128*a-c* can be defined by respective slot surfaces 126*a-g*. Said another way, each "slot volume" can be considered as a channel that cooperates with other channels to define the shape of the keyed profile 124*a*, and therefore defining the shape and size of the first slot 120*a*. Each slot volume 128*a-c* can be sized according to a respective portion of the handle 116 of the container 102 to properly receive and lock the handle 116 to the tool 100. For instance (see particularly FIGS. 5A, 5B, and 7A-7C), the handle 116 can comprise a first handle portion 130*a*, a second handle portion 130*b*, and a third handle portion 130*c*, which can be formed integrally with each other and outwardly from the face 112. The first handle portion 130*a* can be a thin, vertical portion that has a rectangular cross sectional area, and that extends outwardly from the face 112 of the container 102 like a flange. The second handle portion 130*b* can be a thin, vertical portion having a rectangular cross sectional area that is oriented orthogonally to the first handle portion 130*a*, and that extends on either side of the first handle portion 130*a*. The third handle portion 130*c* can be formed on top of the first and second handle portions 130*a* and 130*b*, and can have the same width as the second handle portion 130*b*, but oriented orthogonally relative to the first and second handle portions 130*a* and 130*b*. Thus, the first and second handle portions 130*a* and 130*b* can define a T-shaped profile or cross sectional area or configuration, such that the "T" is oriented horizontally relative to the base 108 or to the ground. Note that the second handle portion 130*b* may be generally rectangular shaped, or it can be slightly tapered inwardly from top to bottom of the second handle portion 130*b*, so that it can be more easily received in the first slot 120*a*, as noted below.

The first slot 120*a* can be further defined by left and right shoulder portions 131*a* and 131*b* (FIGS. 2A and 2B) that extend from the container interface surface 118*a* and into the first slot 120*a* just short of the slot surface 126*a* about the back surface 126*a* of the first slot 120*a*. Thus, the shoulder portions 131*a* and 131*b* terminate at, and further define, the rear vertical slot volume 128*a* of the first slot 120*a*, and also terminate at and further define the upper horizontal slot volume 128*b*. That is, the first shoulder portion 131*a* is defined by orthogonal slot surfaces 126*d* and 126*e*, and the second shoulder portion 131*b* is defined by orthogonal slot surfaces 126*f* and 126*g*.

Figure 5A:
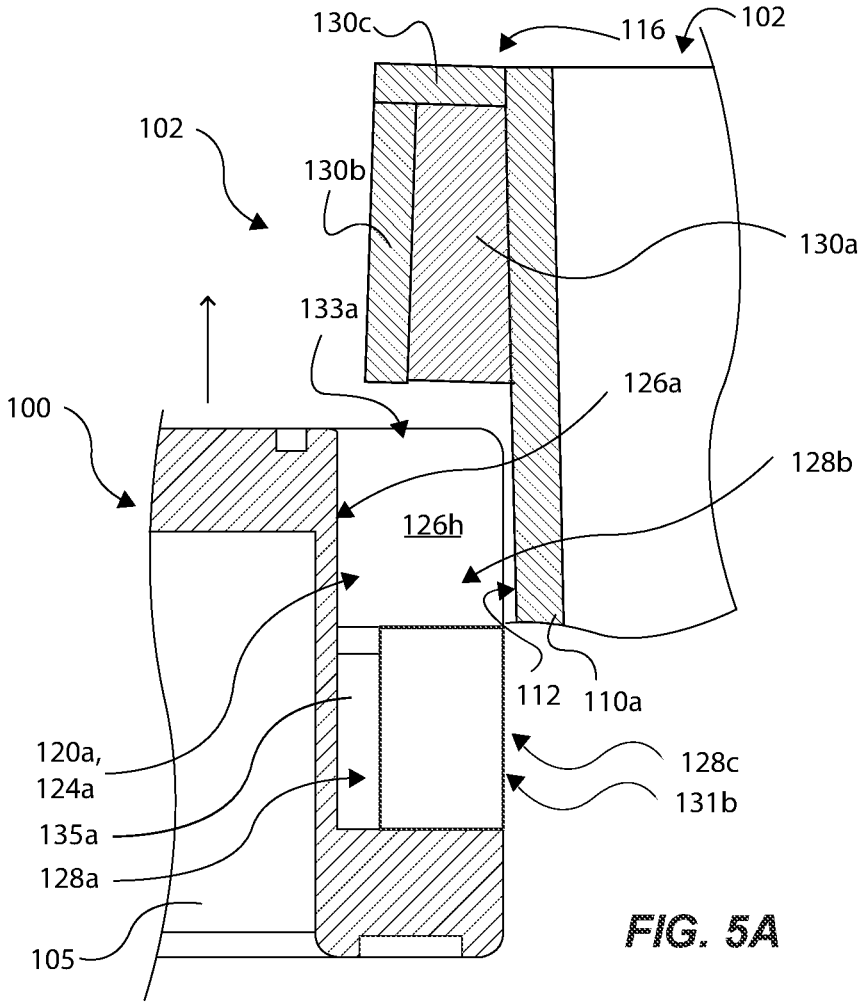
FIG. 5A is a cross sectional view of the universal handle attachment tool of FIG. 1A and the container shown in FIG. 4, showing the first tool side of the handle attachment tool ready to receive the handle of the first container.
Figure 5B:
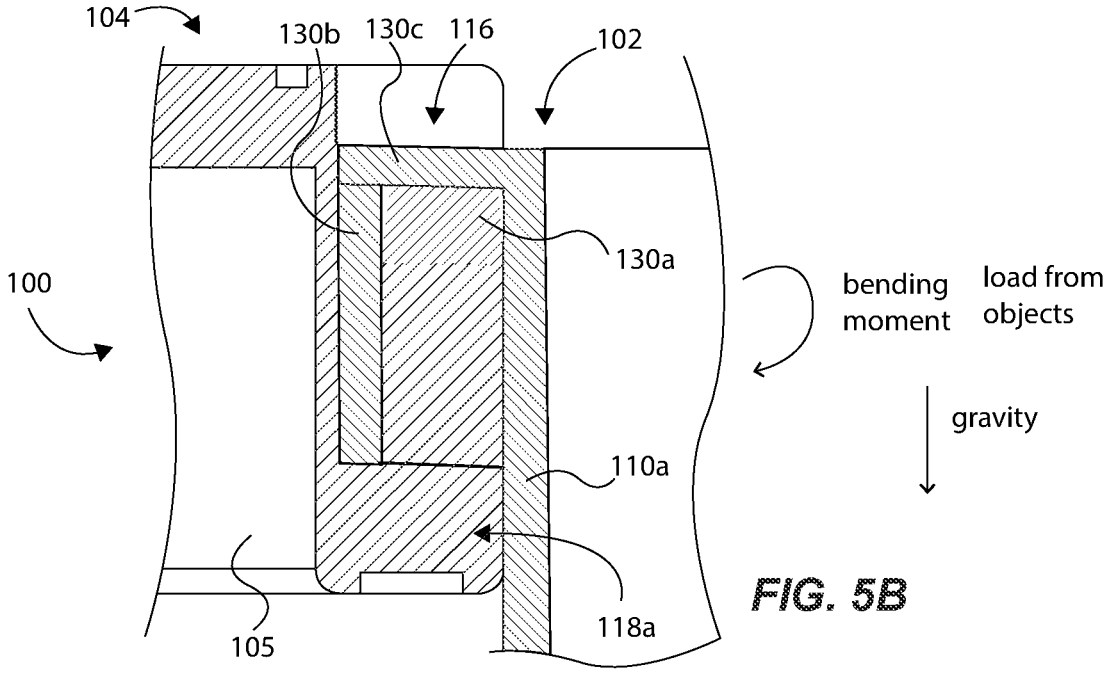
FIG. 5B is a cross sectional view of the universal handle attachment tool of FIG. 1A and the container shown in FIG. 4, taken along lines 5B-5B of FIG. 4, showing the handle attachment tool locked to the first container.

Turning to the operation of interfacing or locking the handle attachment tool 100 to the container 102 for manipulation of the container, FIG. 5A illustrates a disengaged position in which the handle 116 is above, and disengaged from the first slot 120*a*, while FIG. 5B illustrates an engaged position in which the handle attachment tool 100 has been moved vertically upwardly so that the first slot 120*a* receives and engages with the handle 116 of the container 102. In the position of FIG. 5A, the container interface surface 118*a* of the tool 100 is interfaced to the face 112 of the container 102, and the handle 116 is positioned above the first slot 120*a*, so that the tool 100 is ready and in a position to be slid upwardly along the face 112 of the container 102 to receive and lock the handle 116 to the tool 100 via the first slot 120*a*.

The first slot 120*a* can comprise a top opening 133*a* formed through the upper surface 122*a* to facilitate receiving the lower end of the handle 116. Accordingly, while the tool 100 is being slid upwardly along the face 112, the second handle portion 130*b* slides down into and is received by the rear vertical slot volume 128*a*, while the first handle portion 130*a* slides down into and is received by the lower horizontal slot volume 128*c* between the shoulders 131*a* and 131*b* of the first slot 120*a*. Once the first slot 120*a* has fully received the handle 116, the third handle portion 130*c* is situated in the upper horizontal slot volume 128*b*. Thus, when the first slot 120*a* has fully received the handle 116, the second handle portion 130*b* is captured or trapped in the rear vertical slot volume 128*a* by virtue of the end surfaces of the left and right shoulder portions 131*a* and 131*b* that cooperate with the slot surface 126*a* to capture the second handle portion 130*a* in the rear vertical slot volume 128*a*. This locking configuration prevents the container 102 from rotating downwardly relative to the tool 100 due to a load from objects in the container 102, for instance.

Note that the first slot 120*a* can further comprise inner tapered sidewalls 135*a* and 135*b* (see also FIGS. 2A and 2B) proximate a lower side of the rear vertical slot volume 128*a*. The inner tapered sidewalls 135*a* and 135*b* are formed to reduce the width of the rear vertical slot volume 128*a* as the second handle portion 130*b* is slid down into the rear vertical slot volume 128*a* to provide or ensure a secure, tight fit between the handle 116 and the tool 100. In this manner, as noted above, the second handle portion 130*b* can be slightly tapered inwardly toward the bottom end of the second handle portion 130*b*, so that it can slide tightly down along the tapered sidewalls 135*a* and 135*b*. Note that the lower slot surface 126*c* can act as a bottom "stop surface" having a surface area (e.g., T-shaped surface) corresponding to a lower surface area of the first and second handle portions 130*a* and 103*b* of the handle 116 (e.g., T-shaped lower surface defined by handle portions 130*a* and 130*b*).

The first slot 120*a* traps or locks the handle 116 because the keyed profile 124*a* is shaped corresponding to the size of the handle 116. Locking in this manner thereby counteracts a bending moment that exists between the handle 116 and the container 102. That is, the objects in the container 102 may have a center of mass situated away from the handle 116, so that when lifting the container 102 via the handle 116, the container 102 will tend to rotate downwardly toward the ground due to gravity. However, the slot surface 126*a* and the shoulder portions 131*a* and 131*b* cooperate to prevent the second handle portion 130*b* from rotating or falling out of the first slot 120*a*, thereby counteracting the load from the weight of the container 102 and the objects therein.

Further to this concept of counteracting such load, the first container interface surface 118*a* contributes to locking the handle attachment tool 100 to the container 102 to restrict movement of the container 102 relative to the handle attachment tool 100 and to counteract the load from the objects in the container 102. The first container interface surface 118*a* can extend laterally in opposing directions beyond the first slot 120*a* and on either sides of the first slot 120*a* (see particularly FIGS. 1A and 4). Also, a portion of the first container interface surface 118*a* extends directly below the first slot 102*a*. Thus, the first container interface surface 118*a* can comprise a surface configuration corresponding to a surface configuration of the face 112 of the container 102 for surface-to-surface contact between the handle attachment tool 100 and the container 102 to facilitate distribution of one or more loads acting between the handle attachment tool 100 and the container 102. More specifically, the surface configuration of the first container interface surface 118*a* can comprise a curved surface profile P1 that extends in a curved manner between left and right corners of the first container interface surface 118*a*, as best illustrated in FIGS. 3 and 4. The curved surface profile P1 can be defined by the entire surface area of the first container interface surface 118*a*. Indeed, the first container interface surface 118*a* can comprise a concave shape along a single plane. Similarly, the surface configuration of the face 112 of the container 102 can comprise a curved surface profile P2 that extends in a curved manner between left and right sides/corners of the face 112, as best illustrated in FIG. 4. Thus, the face 112 can comprise a convex shaped surface along a single plane that operates to mate or interface with the curved configuration of the first container interface surface 118*a* of the handle attachment tool 100. Accordingly, when the handle attachment tool 100 is interfaced to the face 112 (and locked to the container 102), the entirety of (or a majority of) the surface of the first container interface surface 118*a* is biased and interfaced to at least some of the surface area of the face 112. This generates a surface-to-surface contact configuration that distributes load(s) along or between the surfaces of the face 112 and of the tool 100. This, combined with the aforementioned locking configuration of the first slot 120*a* and the handle 116, cooperate to support the container 102 via the handle attachment tool 100 to restrict rotational movement of the container in all three degrees of rotational freedom, because the handle 116 is locked into the keyed profile 124*a* of the first slot 120*a*, and because the first container interface surface 118*a* is entirely interfaced to the face 112 of the container 102. Accordingly, a user can grasp the handle attachment tool 100 and operate it to lock to the container 102 via the handle 116 and the face 112, so that the user can lift and move the container 102 without the container 102 moving or wiggling or rotating relative to the handle attachment tool 100. This provides a more stable means for manipulating the container 102 without the risk of the container 102 falling out of the handle attachment tool 100 and onto the ground, for instance.

The first container interface surface 118*a* can further define a width W1 defined by a width between the left and right corners of the first side 106*a* of the tool 100 (as further illustrated in FIGS. 3 and 4). The face 112 of the container 102 can also define a width W2 defined by a width between the left and right corners of the container 102. Note that the width W1 can be the same or similar as the width W2 (or slightly smaller than width W2), which can accommodate a more stable locking interface between the handle attachment tool 100 and the container 102. This can also accommodate clearance of the handle attachment tool 100 into narrow areas or openings to interface with and lift the container 102, such as may be the case with an access doorway or opening of a container dispenser assembly operable to provide and dispense the container 102 (see e.g., FIGS. 10A and 10B).

The first tool side 106*a* is operable to engage with a "small" container or bin 102 (FIGS. 1B and 4), and the second tool side 106*b* is operable to engage with a "large" container or bin 202 (FIGS. 8A and 8B), and the third tool side 106*c* is operable to engage with a "red" or irregular shaped container or bin 302 (FIGS. 9A and 9B), and finally, the fourth tool side 106*d* is operable to engage with a "medium" container or bin (not shown). The small, medium, and large containers or bins may have the same radius defined by their respective faces (e.g., 112, 212), and can be stacked in side by side manner and supported by a container dispenser assembly (e.g., FIG. 10A), so that each container may be part of a "pie" shaped arrangement of other containers. The tool 100 can include words or indicia on the tool 100 to indicate to a user which tool side is for which size of container or bin. The tool 100 can further comprise chamfered or rounded corners, as illustrated, for a more ergonomic feeling when using the tool.

Figure 8A:
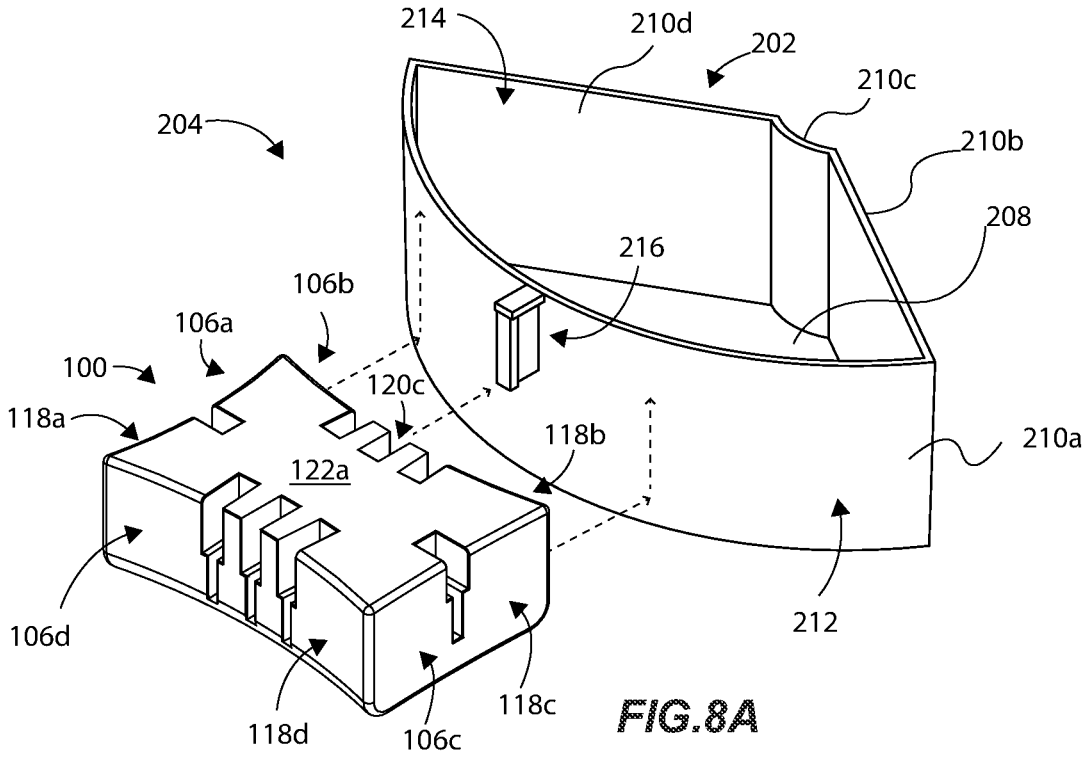
FIG. 8A is an isometric view of the universal handle attachment tool of FIG. 1A, showing a second tool side ready for engagement to a second container to lock the universal handle attachment tool to the second container.
Figure 8B:
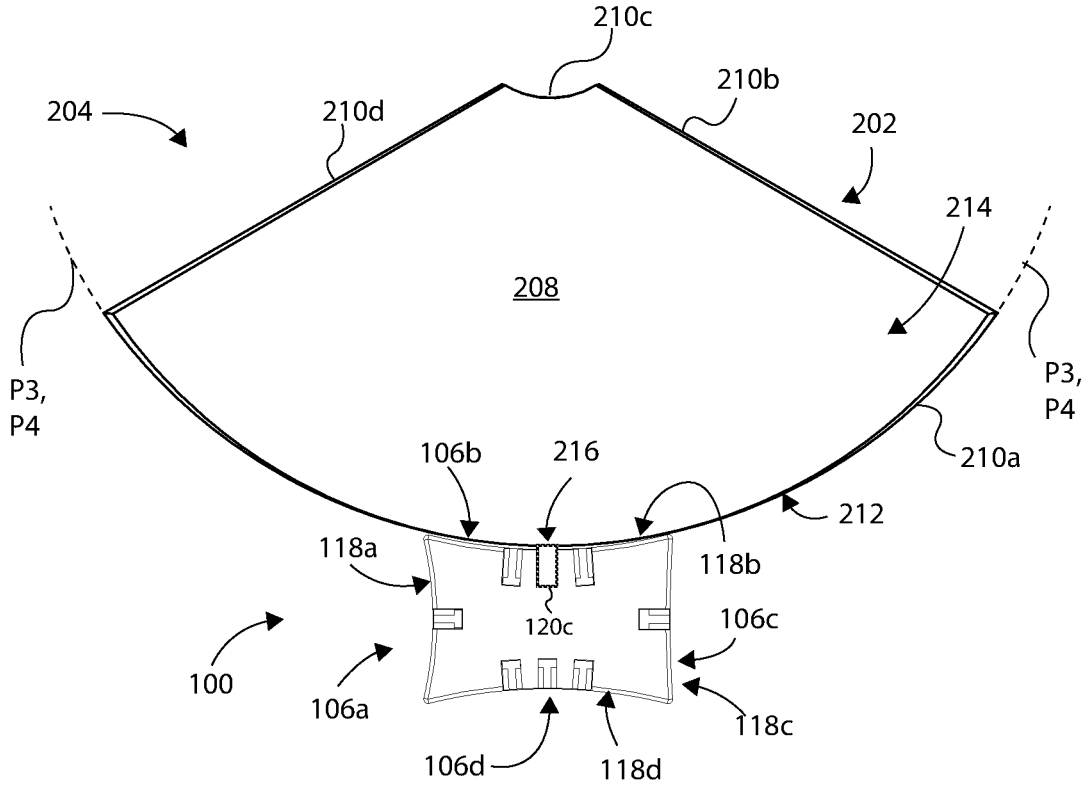
FIG. 8B is a top view of the second tool side of the universal handle attachment tool of FIG. 1A, as engaged with the second container of FIG. 8A.

FIGS. 8A and 8B show a system 204 including the universal handle attachment tool 100 and a container 202 to facilitate manipulation of the container 202 via the tool 100, in accordance with an example of the present disclosure. In this example, a second tool side 106*b* is operable with the container 202 (e.g., large bin), which is a different size of container than container 102 (e.g., small bin). Accordingly, the container 202 can comprise a base 208 and a plurality of sidewalls 210*a-d* that extend upwardly from the base 208. A first sidewall 210*a* of the plurality of sidewalls 210*a-d* can comprise a face 212. The container 202 can comprise an interior volume 214 defined, at least in part, by the base and the plurality of sidewalls 210*a-d* for supporting at least one object. The container 202 can further comprise a handle 216 formed outwardly from the face 212, which can have the same shape and size as handle 116 described above. Also similarly as described above regarding the first tool side 106*a*, the second tool side 106*b* is configured to interface with the container 202 by locking the handle 216 to the second tool side 106*b* of the handle attachment tool 100. Therefore, a user can grasp the handle attachment tool 100 and slide it upwardly relative to the handle 216 to lock the handle 216 to the handle attachment tool 100 via the second tool side 106*b*, as illustrated by the dashed arrows in FIG. 8A. Then, the user can lift the container 202 via the handle attachment tool 100 to manipulate or transport the container 202.

The second tool side 106*b* can comprise a second container interface surface 118*b* operable to engage the face 212 of the container 202. One or more container handle interface slots (e.g., see second, third and fourth container handle interface slots 120*b-d*, or simply slots 120*b-d*) can be formed through the container interface surface 118*b* of the body 105, and also formed through the upper surface 122*a* of the body 105. The container handle interface slots 120*b-d* can be shaped and sized similarly as the first slot 120*a* described above, and therefore each slot 120*b-d* is operable to receive the handle 216 of the container 202. Note that the slots 120*b-d* may be formed deeper laterally into the body 105 (see FIG. 4) to accommodate a wider handle 216 than the handle 116. Accordingly, each slot 120*b-d* can comprise a keyed profile (e.g., like 124*a*) operable to interface and receive the handle 216 of the container 202. That is, the keyed profile of each slot 120*a-d* can be sized and shaped to correspond to the size and shape of the handle 216, similarly as described above regarding FIGS. 1A-7C.

Note that, one purpose of forming more than one slot (e.g., three slots 120*b-d*) through the container interface surface 118*b* is to accommodate for different lateral positions in which the container 202 may be placed in by a container dispenser assembly. More specifically, a container dispenser assembly (that rotates and provides the container 202 to a user through an access doorway) may not always properly position the container 202, which may make it difficult or impossible to fit the tool 100 through the access doorway to engage with the container 202, because of the limited size and clearance of the access doorway. Thus, the user can use one of the other slots (e.g., 120*b* or 120*d*) to engage the the handle 216 for lifting and removing the container 202 from the container dispenser assembly, for instance, if necessary.

Much like the first container interface surface 118*a*, the second container interface surface 118*b* extends in opposing directions beyond and on sides of the slots 120*b-d*, and comprises a surface configuration corresponding to a surface configuration of the face 212 of the container 202 for surface-to-surface contact between the handle attachment tool 100 and the container 202. More specifically, the surface configuration of the second container interface surface 118*b* can comprise a curved surface profile P3 that extends in a curved manner between left and right corners of the second container interface surface 118*b*, as best illustrated in FIG. 8B. Thus, the second container interface surface 118*b* can comprise a concave shape along a single plane. Similarly, the surface configuration of the face 212 of the container 202 can comprise a curved surface profile P4 that extends in a curved manner between left and right corners of the face 212. Thus, the face 212 can comprise a convex shaped surface along a single plane that mates or interfaces with the curved surface of the second container interface surface 118*b* of the handle attachment tool 100. Accordingly, when the handle attachment tool 100 is interfaced to the face 212 (and locked to the container 202), the entirety of, or a majority of, the surface of the second container interface surface 118*b* is biased to or interfaced with some of the face 212. This generates a surface-to-surface contact configuration that distributes loads along or between the surfaces of the face 112 and of the tool 100. This, combined with the aforementioned locking configuration of the second slot 120*c* and the handle 216, functions to support the container 202 via the handle attachment tool 100 to counteract the load from the objects in the container 202. Accordingly, a user can grasp the handle attachment tool 100 and operate it by locking it to the container 102 via the handle 216 and the face 212, so that the user can lift and move the container 202 without the container 202 moving or wiggling or rotating relative to the handle attachment tool 100. This provides a more stable means for manipulating the container 202 without the risk of the container 202 falling out of the handle attachment tool 100 and onto the ground, for instance. This is particularly advantageous with the container 202 because of its large size that is capable of potentially supporting relatively more objects and potentially more weight therein than the container 102 discussed above.

Figure 6A:
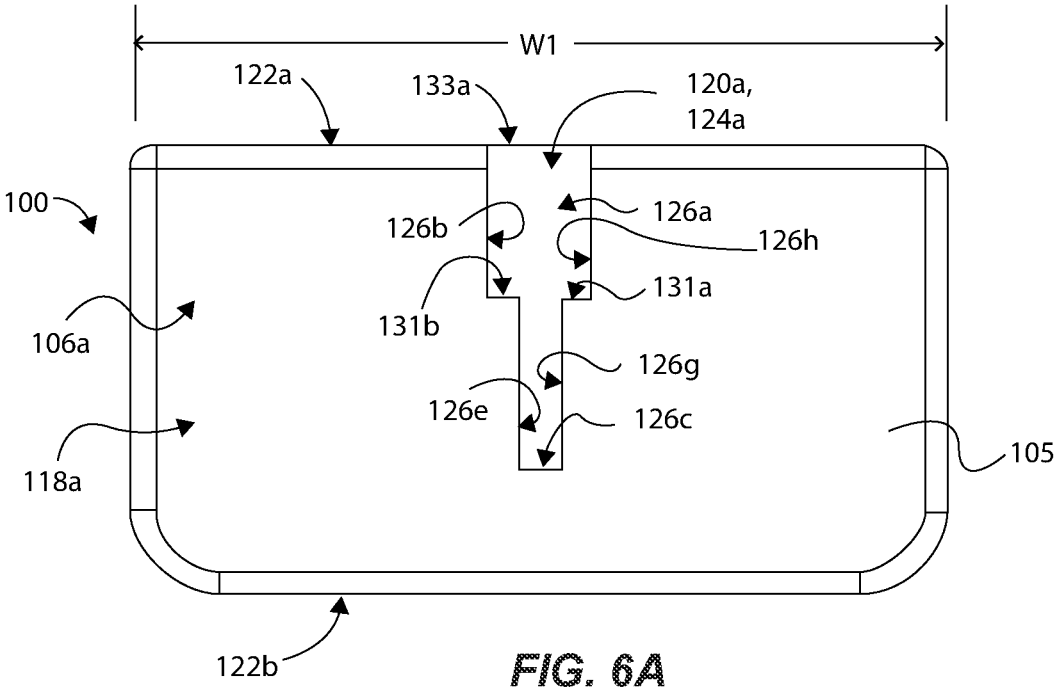
FIG. 6A is a front view of a first tool side of the handle attachment tool of FIG. 1A.
Figure 6B:
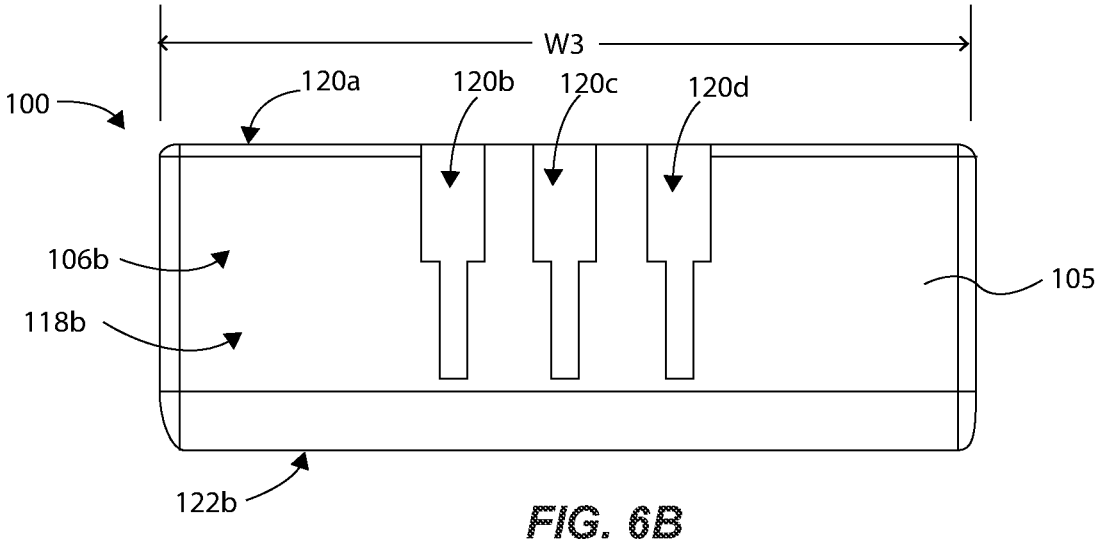
FIG. 6B is a front view of a second tool side of the handle attachment tool of FIG. 1A.
Figure 7A:
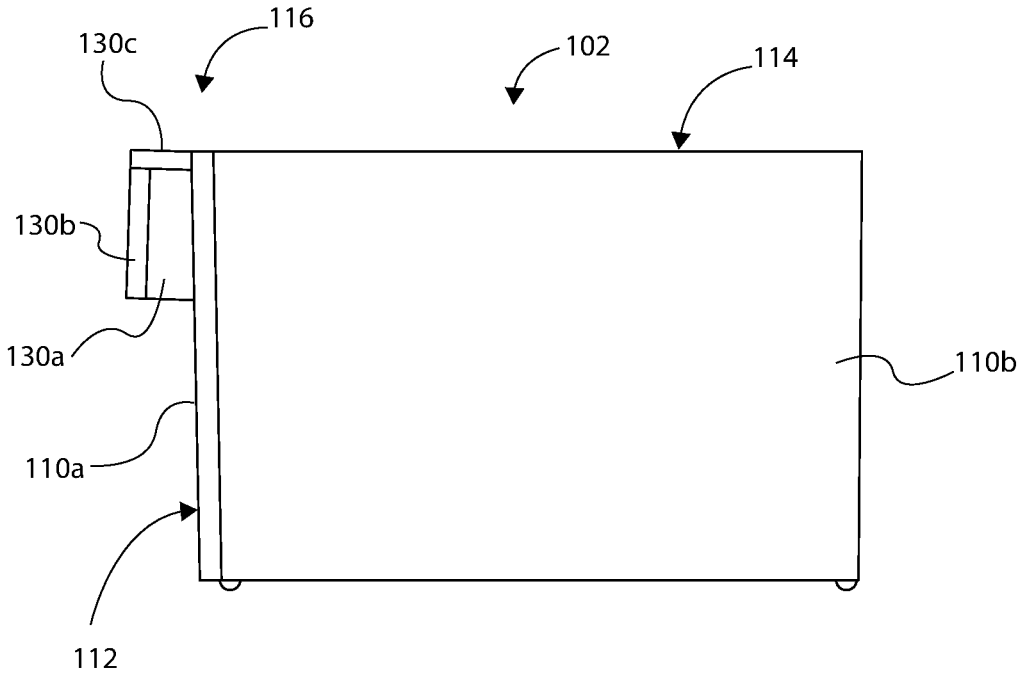
FIG. 7A is a side view of the first container of FIGS. 1B and 4.
Figure 7B:
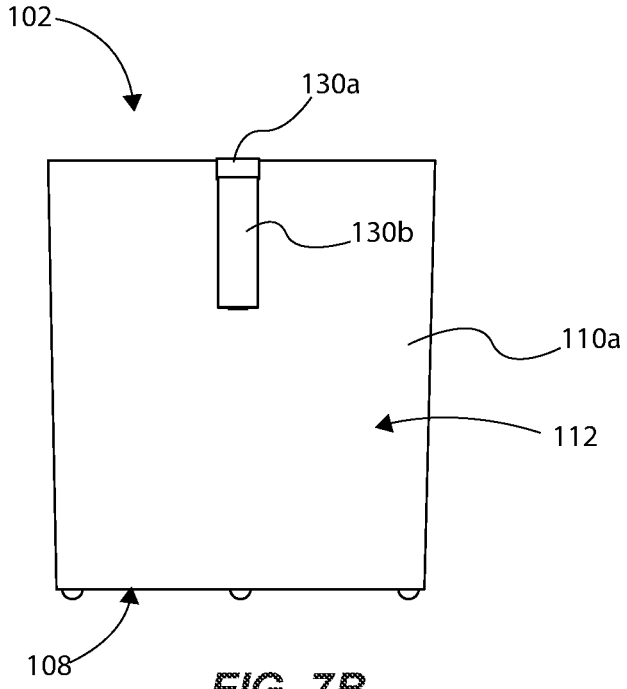
FIG. 7B is a front view of the first container of FIGS. 1B and 4.
Figure 7C:
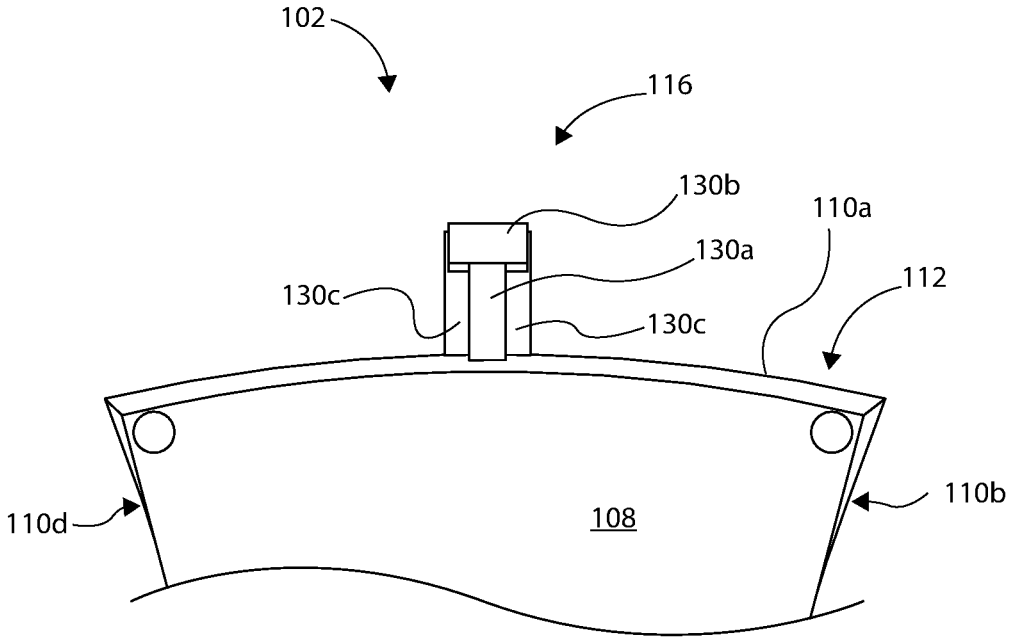
FIG. 7C is a bottom view of the first container of FIGS. 1B and 4.

As further illustrated in FIG. 6B, the second container interface surface 118*b* can define a width W3 defined by a width between the left and right corners of the second container interface surface 118*b*. Note that width W3 is greater than width W1 of the first container interface surface 118*a*, which can accommodate a more stable locking interface between the handle attachment tool 100 and the container 202 because of the greater surface-to-surface contact area between the second tool side 106*b* and the face 212 of the container 202 (FIG. 8B). Further note that the handle attachment tool 100 can be considered "universal" because it is operable to lock to and manipulate both of the different sizes of containers 102 and 202 (and operable with a total of at least four different sizes of containers or bins, as noted above).

Figure 9A:
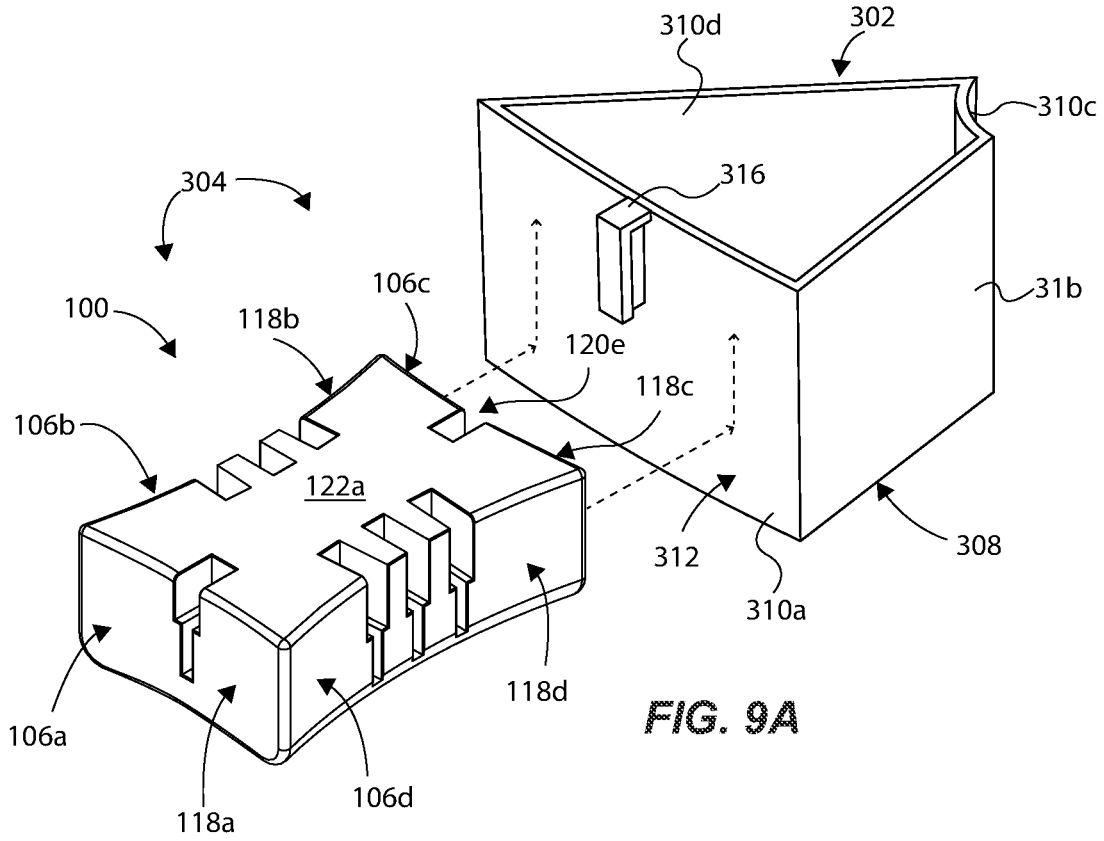
FIG. 9A is an isometric view of the universal handle attachment tool of FIG. 1A, showing a third tool side ready for engagement to a third container to lock the universal handle attachment tool to the third container.
Figure 9B:
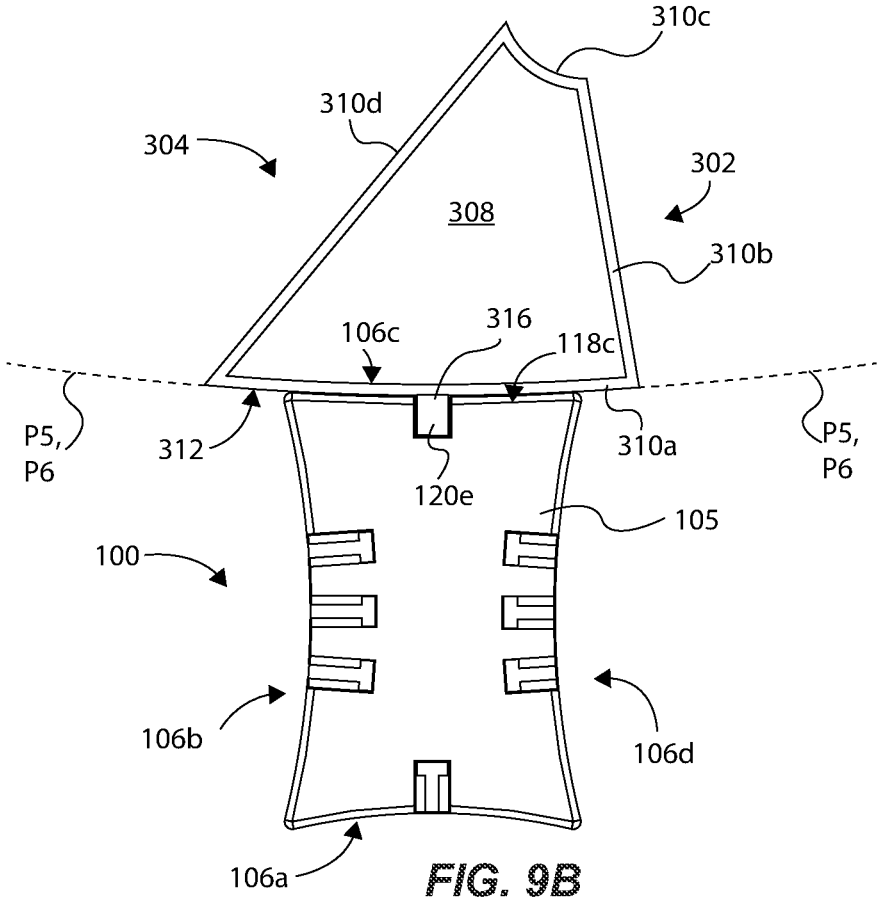
FIG. 9B is a top view of the third tool side of the universal handle attachment tool of FIG. 1A, as engaged to the third container of FIG. 9A.

FIGS. 9A and 9B show a system 304 including the universal handle attachment tool 100 and a container 302 to facilitate manipulation of the container 302 via the tool 100, in accordance with an example of the present disclosure. In this example, a third tool side 106*c* of the tool 100 is operable with the container 302, which is a different size and shape of container than containers 102 and 202, as illustrated. Accordingly, the container 302 can comprise a base 308 and a plurality of sidewalls 310*a-d* that extend upwardly from the base 308. A first sidewall 310*a* of the plurality of sidewalls 310*a-d* can comprise a face 312. The container 302 can comprise an interior volume 314 defined, at least in part, by the base and the plurality of sidewalls 310*a-d* for supporting at least one object. The container 302 can further comprise a handle 316 formed outwardly from the face 312, which can have the same shape and size as handle 116 described above. Also similarly as described above regarding the first tool side 106*a*, the third tool side 106*c* is configured to interface with the container 302 by locking the handle 316 to the handle attachment tool 100, such that a user can grasp the handle attachment tool 100 and slide it upwardly relative to the handle 316 to lock the handle 316 to the handle attachment tool 100, as illustrated by the dashed arrows in FIG. 9A. Then, the user can lift the container 302 via the handle attachment tool 100 to manipulate or transport the container 302.

The third tool side 106*c* can comprise a third container interface surface 118*c* operable to engage the face 312 of the container 302. A container handle interface slot 120*e* can be formed through a third container interface surface 118*c* of the body 105, and also formed through the upper surface 122*a* of the body 105. The container handle interface slot 120*e* can be shaped and sized similarly as the first slot 120*a* described above, and therefore the slot 120*e* is operable to receive the handle 316 of the container 302. Thus, the slot 120*e* can comprise a keyed profile (e.g., like 124*a*) operable to interface and receive the handle 316 of the container 302. Accordingly, the keyed profile can be sized and shaped to correspond to the size and shape of the handle 316, similarly as described above regarding FIGS. 1A-7C.

Much like the first container interface surface 118*a*, the third container interface surface 118*c* extends in opposing directions beyond the slot 120*e*, and comprises a surface configuration corresponding to a surface configuration of the face 312 of the container 302 for surface-to-surface contact between the handle attachment tool 100 and the container 302. More specifically, the surface configuration of the third container interface surface 118*c* can comprise a surface profile P5 that extends between left and right corners of the third container interface surface 118*c*, as illustrated in FIG. 9B. Thus, the third container interface surface 118*c* can comprise a slightly tapered or irregular shape along a single plane. Similarly, the surface configuration of the face 312 of the container 302 can comprise a surface profile P6 that extends in a tapered or irregular manner between left and right corners of the face 312. Thus, the face 312 mates or interfaces with the third container interface surface 118*c* of the handle attachment tool 100. Accordingly, when the handle attachment tool 100 is interfaced to the face 312 (and locked to the container 302), the entirety or a majority of the surface of the third container interface surface 118*c* is biased to or interfaced to surface of the face 312. This generates a surface-to-surface contact configuration that distributes loads along or between the surfaces of the face 312 and of the tool 100. This, combined with the aforementioned locking configuration of the slot 120*e* and the handle 316, functions to support the container 302 via the handle attachment tool 100. Accordingly, a user can grasp the handle attachment tool 100 and operate it to lock to the container 302 via the handle 316 and the face 312, so that the user can lift and move the container 302 without the container 302 moving or wiggling or rotating relative to the handle attachment tool 100. This provides a more stable means for manipulating the container 302 without the risk of the container 302 falling out of the handle attachment tool 100 and onto the ground, for instance.

Figure 10B:
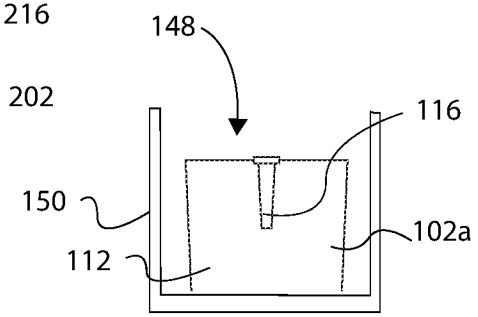
FIG. 10B is a front view of an access opening of the container dispenser assembly of FIG. 10A for accessing and removing a container with the handle attachment tool of the present disclosure.
Figure 10A:
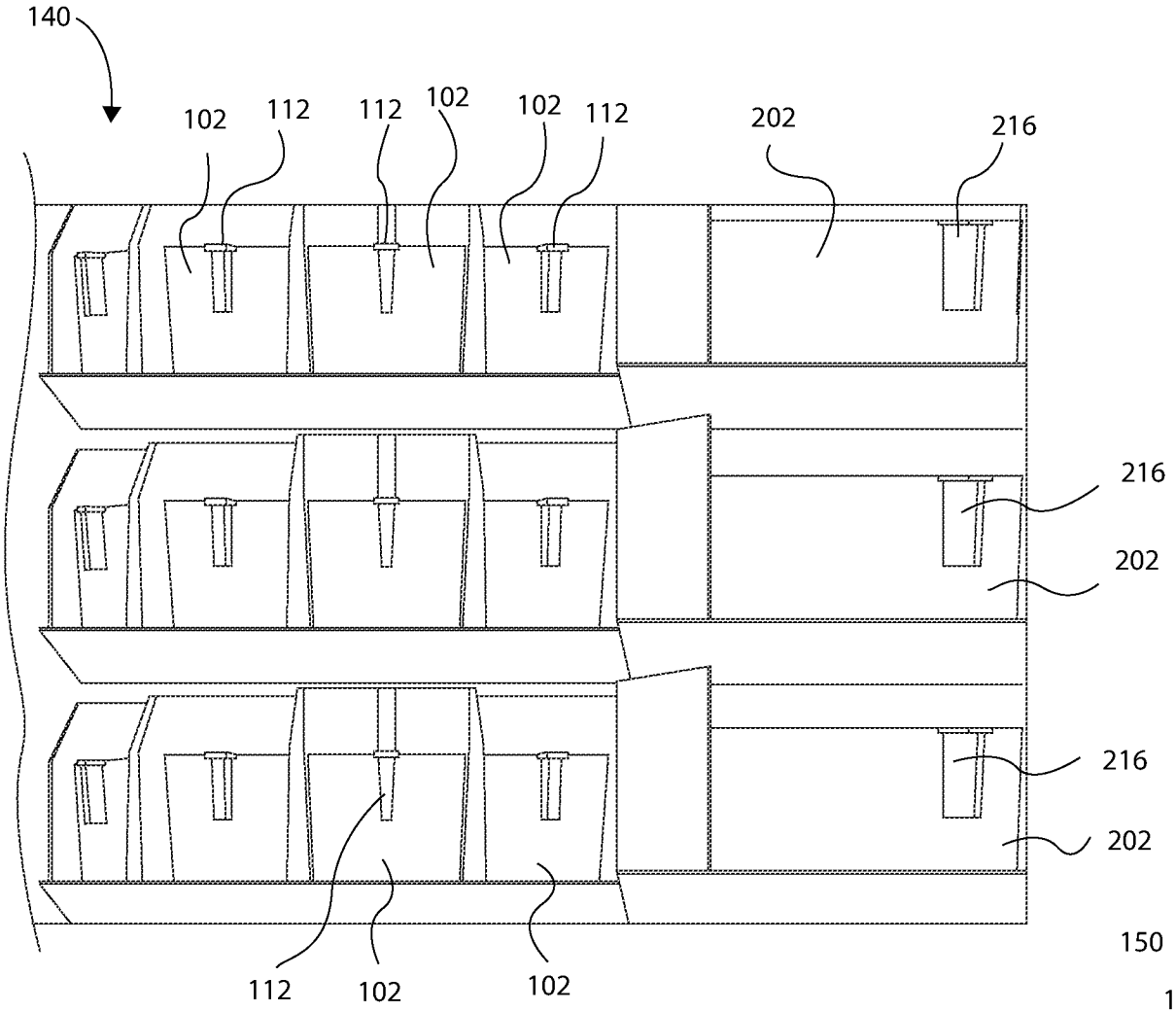
FIG. 10A illustrates a portion of a container dispenser assembly supporting a plurality of containers usable with the handle attachment tools of the present disclosure, in accordance with an example of the present disclosure.

FIG. 10A illustrates a perspective front view of a section of a traditional container dispenser assembly 140 that supports a plurality of containers, such as containers 102 and 202, as shown and labeled. The container dispenser assembly 140, and the containers 102 and 202, can be the same or similar as those marketed and sold by AutoCrib®, or the containers can comprise other makes, models, or types as will be apparent and recognized by those skilled in the art. The container dispenser assembly 140 can have stacked racks that rotate to provide a selected container 102*a* to a user for removing the selected container 102*a* from the assembly. For instance, FIG. 10B shows the selected container 102*a* provided by the assembly 140 to an access opening 148 defined by a plurality of sides 150, as schematically illustrated. Thus, a user can insert the handle attachment tool 100 into the access opening 148, and then engage the first container interface surface 118*a* to the face 112 of the container 102*a*, and then lift the tool 100 to slide the handle 116 into first slot 120*a* to lock the tool 100 to the container 102. Then, the user can lift and remove the container 102*a* from the access opening 148 for use of the object(s) supported by the container 102*a*.

Figure 11A:
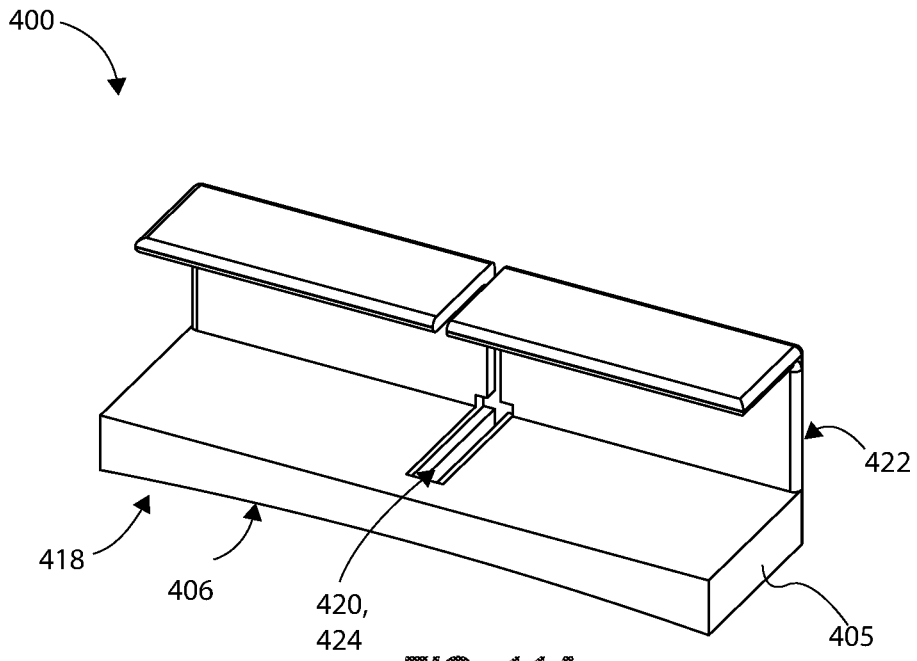
FIG. 11A is an isometric view of a handle attachment tool, in accordance with an example of the present disclosure.
Figure 11B:
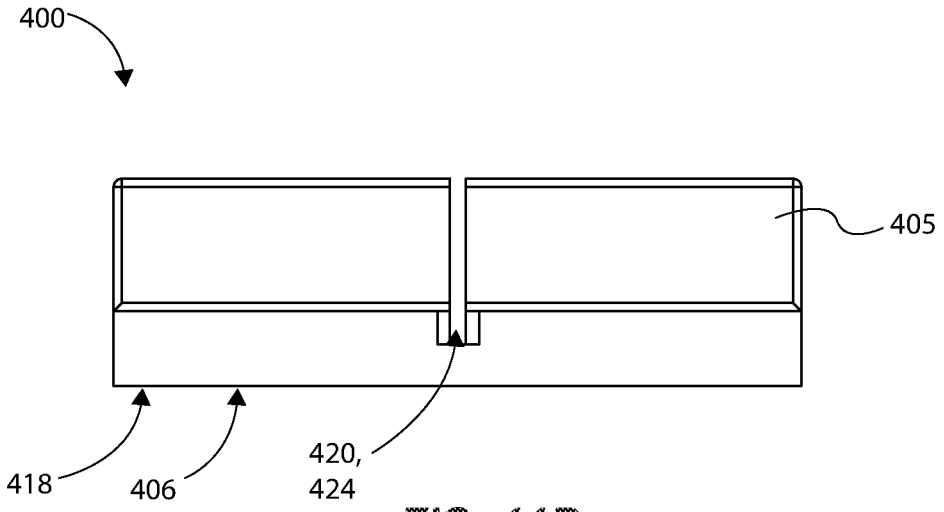
FIG. 11B is a top view of the handle attachment tool of FIG. 11A.

FIGS. 11A and 11B illustrate a handle attachment tool 400 operable to engage a container (e.g., 102, 202) to facilitate manipulation (e.g., lifting and moving) of the container, in accordance with an example of the present disclosure. The handle attachment tool 400 can comprise a body 405 shaped and sized to be grasped and moved by a user. The body 405 can comprise a tool side 406 comprising a container interface surface 418 operable to engage a face (e.g., 112) of the container (e.g., 102). The handle attachment tool 400 can further comprise a container handle interface slot 420 (or "slot") formed through the container interface surface 418 of the body 405, and also formed through an upper surface 422 of the body 405. The slot 420 can be shaped and sized, or operable, to receive a handle (e.g., 116) of the container (e.g., 102). The slot 420 can comprise a keyed profile 424 operable to interface with and receive the handle of the container. The keyed profile 424 can be sized and shaped to correspond to the size and shape of the handle, similarly as described above regarding slot 120*a*. Likewise, the container interface surface 418 can comprise a surface configuration corresponding to a surface configuration of the face (e.g., 112, 212) of the container (e.g., 102, 202) for surface-to-surface contact between the handle attachment tool 400 and the container to facilitate distribution of one or more loads acting between the handle attachment tool 400 and the container, also in a similar manner as discussed above. Accordingly, a user can grasp the handle attachment tool 400 and operate it to lock it to the container via the handle and the face, so that the user can lift and move the container without the container moving or wiggling or rotating relative to the handle attachment tool 400, similarly as described above regarding tool 100.

Figure 12A:
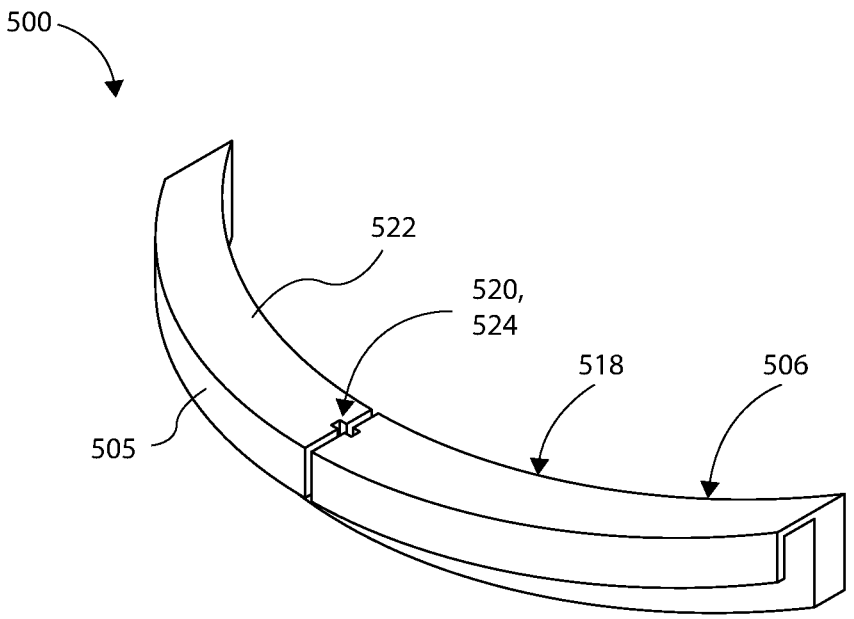
FIG. 12A is an isometric view of a handle attachment tool, in accordance with an example of the present disclosure.
Figure 12B:
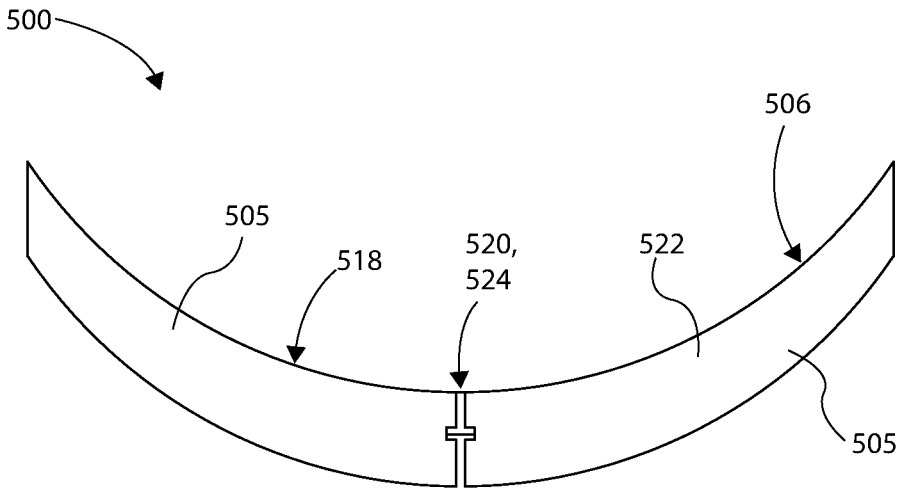
FIG. 12B is a top view of the handle attachment tool of FIG. 12A.

FIGS. 12A and 12B illustrate a handle attachment tool 500 operable to engage a container (e.g., 102, 202) to facilitate manipulation (e.g., lifting and moving) of the container, in accordance with an example of the present disclosure. The handle attachment tool 500 can comprise a body 505 shaped and sized to be grasped and moved by a user. The body 505 can comprise a tool side 506 comprising a container interface surface 518 operable to engage a face (e.g., 112) of the container (e.g., 102). The handle attachment tool 500 can further comprise a container handle interface slot 520 (or "slot") formed through the container interface surface 518 of the body 505, and also formed through an upper surface 522 of the body 505. The slot 520 can be shaped and sized, or operable, to receive the handle (e.g., 116) of the container (e.g., 102). The slot 520 can comprise a keyed profile 524 operable to interface with and receive the handle of the container. The keyed profile 524 can be sized and shaped to correspond to the size and shape of the handle, similarly as described above regarding slot 120*a*. Likewise, the container interface surface 518 can comprise a surface configuration corresponding to a surface configuration of the face (e.g., 112, 212) of the container for surface-to-surface contact between the handle attachment tool 500 and the container to facilitate distribution of one or more loads acting between the handle attachment tool 500 and the container, also as similarly discussed above. Accordingly, a user can grasp the handle attachment tool 500 and operate it to lock it to the container via the handle and the face, so that the user can lift and move the container without the container moving or wiggling or rotating relative to the handle attachment tool 500.

Figure 13A:
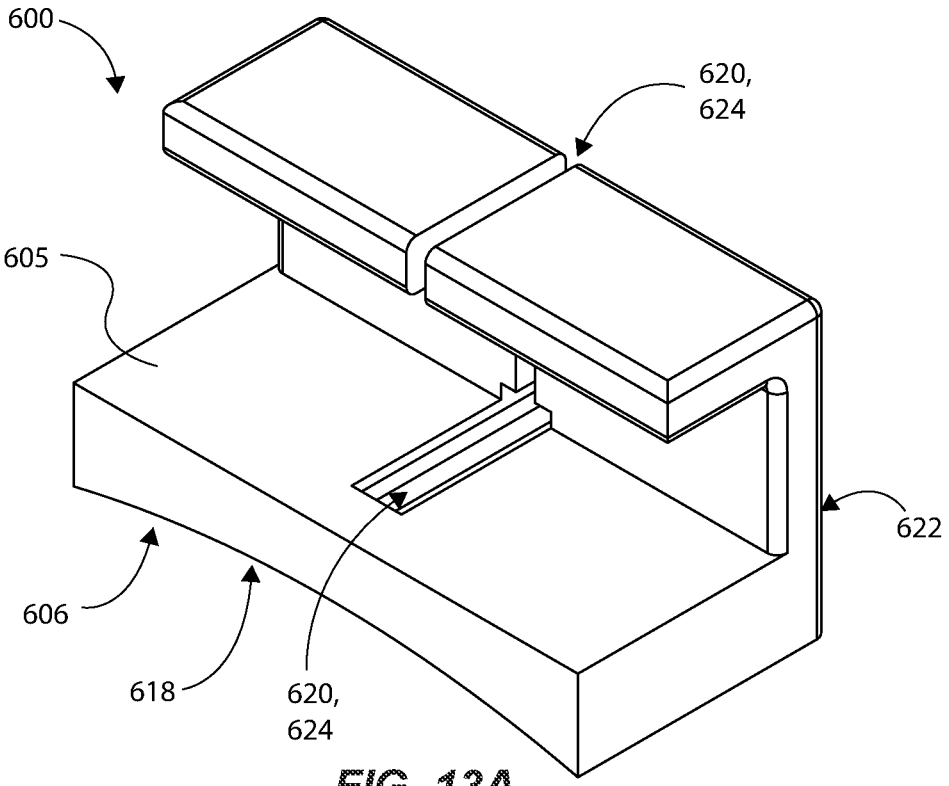
FIG. 13A is an isometric view of a handle attachment tool, in accordance with an example of the present disclosure.
Figure 13B:
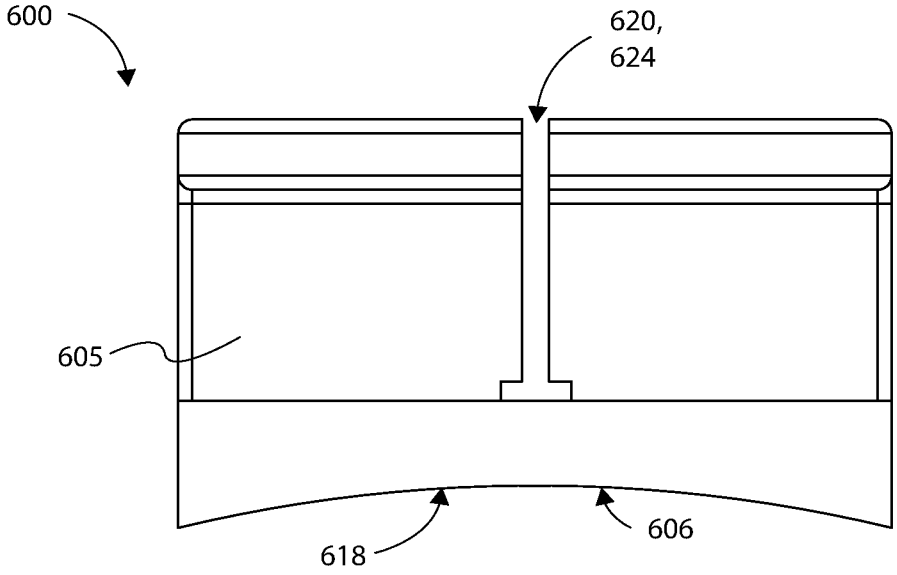
FIG. 13B is a top view of the handle attachment tool of FIG. 13A.

FIGS. 13A and 13B illustrate a handle attachment tool 600 operable to engage a container (e.g., 102, 202, 302) to facilitate manipulation (e.g., lifting and moving) of the container, in accordance with an example of the present disclosure. The handle attachment tool 600 can comprise a body 605 shaped and sized to be grasped and moved by a user. The body 605 can comprise a tool side 606 comprising a container interface surface 618 operable to engage the face (e.g., 112) of the container (e.g., 102). The handle attachment tool 600 can further comprise a container handle interface slot 620 (or "slot") formed through the container interface surface 618 of the body 605, and also formed through an upper surface 622 of the body 605. The slot 620 can be shaped and sized, or operable, to receive the handle (e.g., 116) of the container (e.g., 102). The slot 620 can comprise a keyed profile 624 operable to interface and receive the handle of the container. The keyed profile 624 can be sized and shaped to correspond to the size and shape of the handle, similarly as described above regarding slot 120*a*. Likewise, the container interface surface 618 can comprise a surface configuration corresponding to a surface configuration of the face (e.g., 112, 212) of the container for surface-to-surface contact between the handle attachment tool 600 and the container to facilitate distribution of one or more loads acting between the handle attachment tool 600 and the container, also as similarly described above. Accordingly, a user can grasp the handle attachment tool 600 and operate it to it lock to the container via the handle and the face, so that the user can lift and move the container without the container moving or wiggling or rotating relative to the handle attachment tool 600.

Figure 14A:
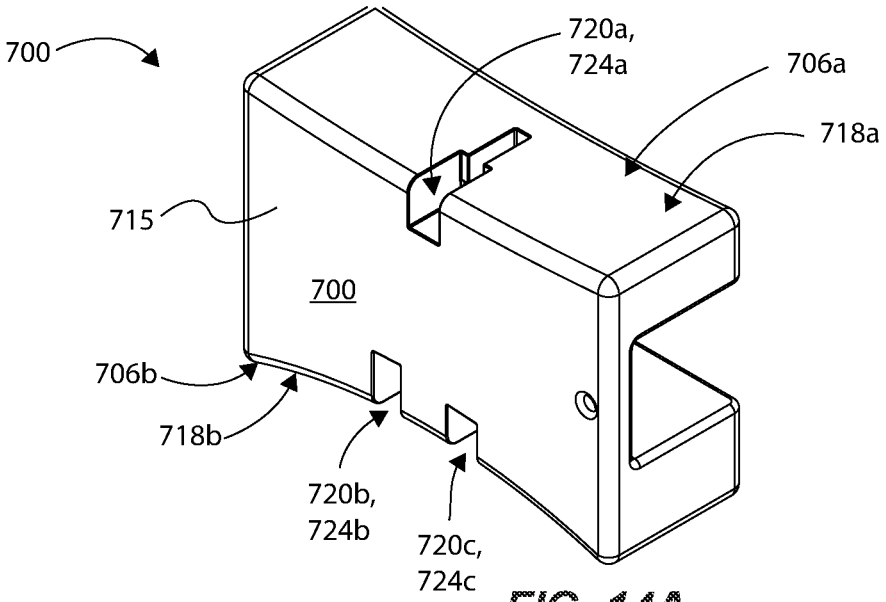
FIG. 14A is an isometric view of a universal handle attachment tool, in accordance with an example of the present disclosure.
Figure 14B:
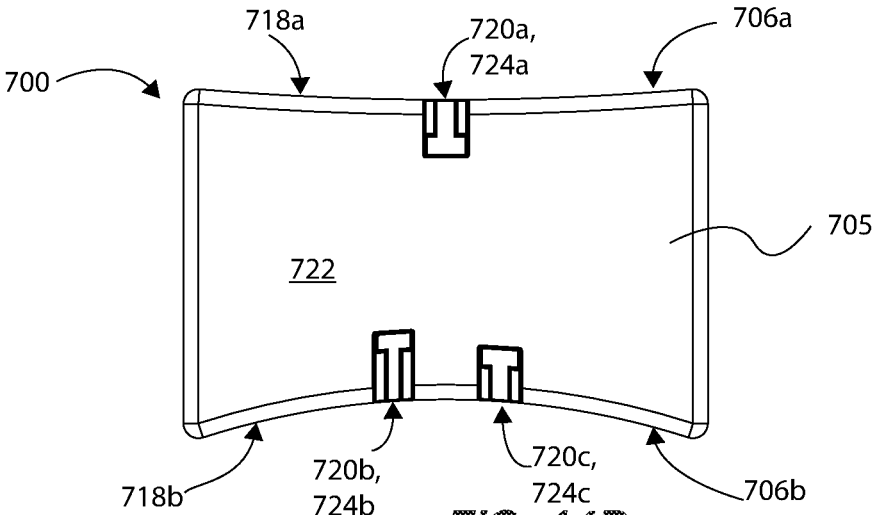
FIG. 14B is a top view of the universal handle attachment tool of FIG. 14A.
Figure 14C:
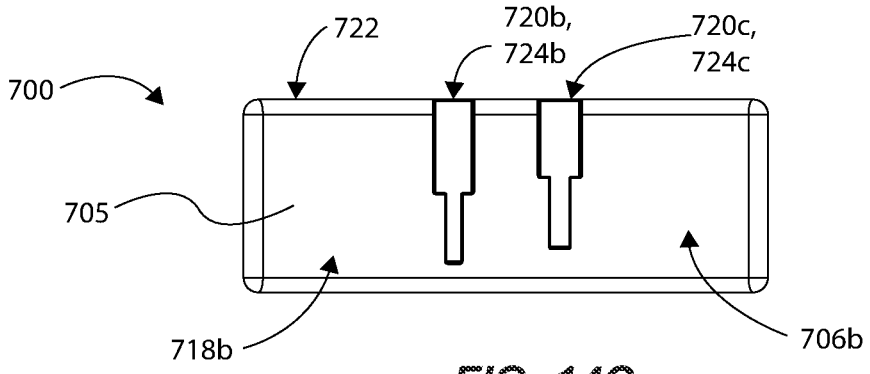
FIG. 14C is a front view of the universal handle attachment tool of FIG. 14A.

FIGS. 14A-14C illustrate a universal handle attachment tool 700 operable to engage a container (e.g., 102, 202, 302) to facilitate manipulation (e.g., lifting and moving) of the container, in accordance with an example of the present disclosure. The handle attachment tool 700 can comprise a body 705 shaped and sized to be grasped and moved by a user. The body 705 can comprise first and second tool sides 706*a* and 706*b* each comprising a container interface surface 718*a* and 718*b* operable to engage a respective face (e.g., 112) of a container (e.g., 102, 202, 302). The first tool side 706*a* can comprise a container handle interface slot 720*a* (or "slot") formed through the container interface surface 718*a* of the body 705, and also formed through an upper surface 722 of the body 705. And similarly, the second tool side 706*b* can comprise container handle interface slots 720*b* and 720*c*. The slots 720*a-c* can each be shaped and sized, or operable, to receive a handle (e.g., 116, 216, 316) of the container (e.g., 102). The slots 720*a-c* can each comprise a keyed profile 724*a-c* operable to interface and receive the handle of the container. Thus, the keyed profiles 724*a-c* can be sized and shaped to correspond to the size and shape of the handle, similarly as described above regarding slot 120*a*. Note, however, that the slots 720*b* and 720*c* each have different heights and depths into the body 705 to accommodate different sized handles of different containers (e.g., medium and large containers or bins).

The container interface surfaces 718*a* and 718*b* can comprise a surface configuration corresponding to a surface configuration of a face (e.g., 112, 212, 312) of the particular container for surface-to-surface contact between the handle attachment tool 700 and the container to facilitate distribution of one or more loads acting between the handle attachment tool 700 and the container. Accordingly, a user can grasp the handle attachment tool 700 and operate it to lock it to the container via the handle and the face, so that the user can lift and move the container without the container moving or wiggling or rotating relative to the handle attachment tool 700.

FIGS. 15A-15D illustrate various views of a container 802, in accordance with an example of the present disclosure. The container 802 can comprise a container body 804 for receiving and supporting at least one object. The container body 804 can be formed (e.g., machined, molded, printed, or otherwise formed) of a unitary piece of material, such as constructed of suitable plastics, polymers, metals, composites, etc. The container body 804 can comprise a base 808, and a plurality of sidewalls 810*a-d* extending upward from the base 808 to define an interior volume 814 for supporting object(s). The container body 804 can comprise a recessed portion 815 formed through a first sidewall 810*a* of the plurality of sidewalls 810*a-d*. The recessed portion 815 can extend inward from a face 812 of the first sidewall 810*a* toward a central area of the inner volume 814.

The recessed portion 815 can define a recessed cavity 817 defined by sidewalls of the recessed portion 815. The container body 804 can further comprise a handle 816 supported by the first sidewall 810*a* and extending outward from the face 812 of the first sidewall 810*a*. In this manner, the handle 816 (or at least a portion of the handle) can span or extend across the recessed cavity 817. Thus, the handle 816 provides a user interface 819 for a user to grasp, and the recessed cavity 817 facilitates clearance of at least one finger of the user upon grasping the handle 816. Indeed, the recessed cavity 817 is large enough for a user to insert one or more fingers in the recessed cavity 817 and behind the handle 816.

Figure 15A:
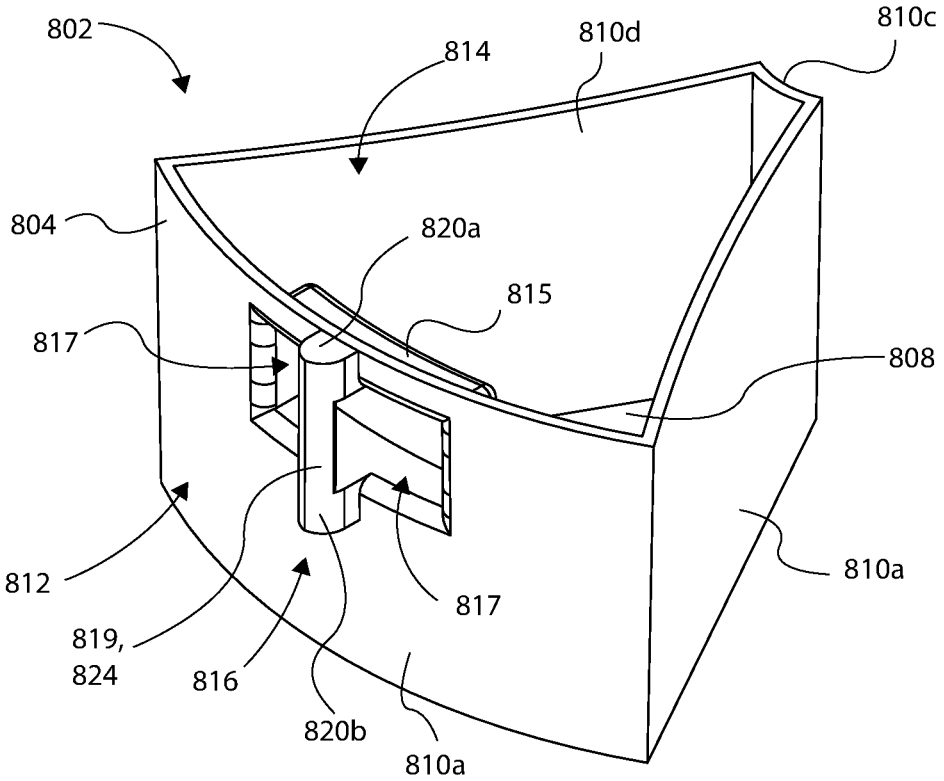
FIG. 15A is an isometric view of a container having a low-profile handle and usable with the container dispenser assembly of FIG. 10, in accordance with an example of the present disclosure.
Figure 15B:
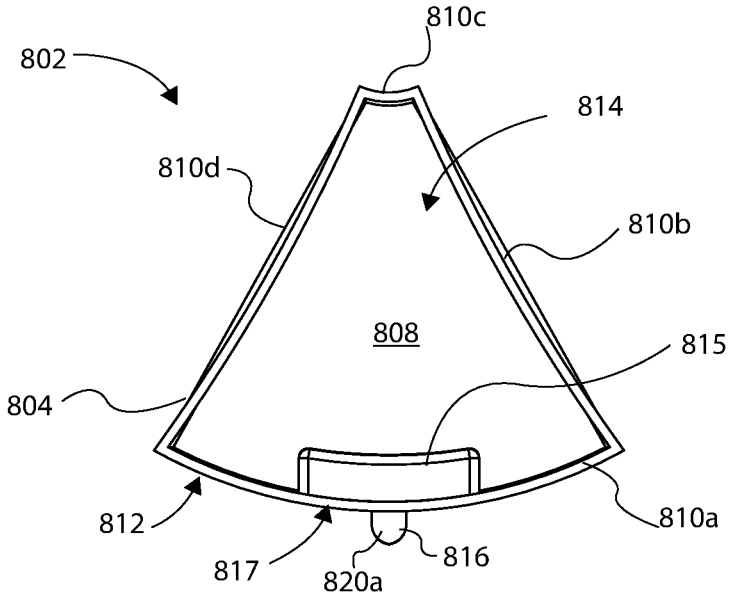
FIG. 15B is top view of the container of FIG. 15A.
Figure 15C:
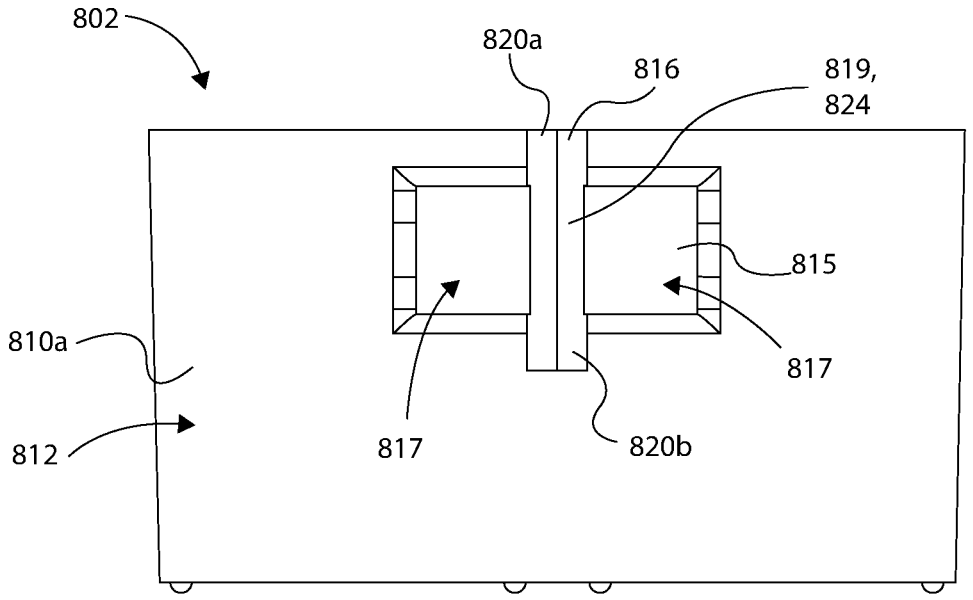
FIG. 15C is front view of the container of FIG. 15A.
Figure 15D:
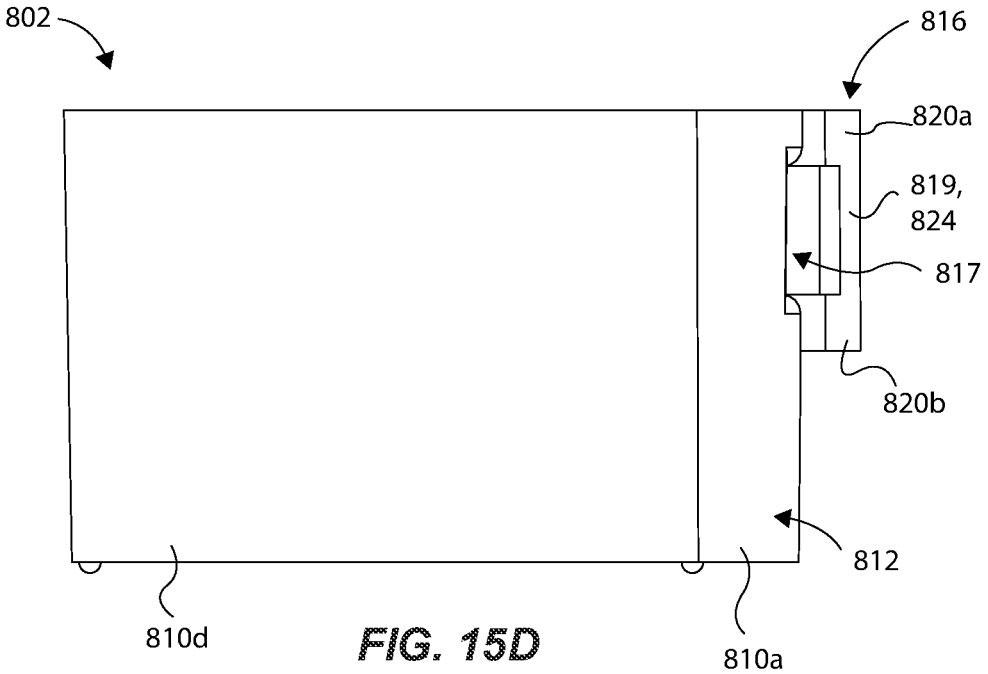
FIG. 15D is side view of the container of FIG. 15A.

Note that the recessed potion 815 and the handle 816 cooperate to provide a low-profile handle that slightly extends outwardly from the face 812, as shown in FIG. 15D. This may be beneficial in scenarios where the container 802 is supported and dispensed by a container dispenser assembly (e.g., FIGS. 10A and 10B), because some of the walls or other components of the container dispenser assembly may be situated very close to the face 812 of the container 802, thereby providing very little clearance for the container 802 to be rotated about the assembly and dispensed to a user. Thus, the handle 816 and the recessed portion 815 cooperate to provide a low-profile handle 816 that can pass through any required clearances of the container dispenser assembly, while providing sufficient clearance behind the handle 816 as provided by the recessed cavity 817 for the user to insert one or more fingers and grasp the handle 816 to manipulate or move the container 802.

In one example, the handle 816 is oriented generally vertically and generally orthogonally relative to a face of the base 808. Alternatively, the handle 816 can be oriented horizontal, or at another suitable angle. The handle 816 can be formed proximate a middle upper area of the face 812, which can assist to better support the weight of the objects in the container 802 because of the location of the handle 816 that counteracts the load of objects in the container 802 when lifted or held by a user. In the example shown, the recessed cavity 817 can extend at least partially into the interior volume 814, or alternatively the recessed portion can be formed into the sidewall (in an example where the sidewall 810*a* is relatively thicker).

The handle 816 can comprises first and second pillar portions 820*a* and 820*b* that extend outwardly from the face 812 adjacent respective top and bottom sides of the recessed cavity 817. The handle 816 can further comprise a bridge grip portion 824 formed between the first and second pillar portions 820*a* and 820*b*, such that the bridge grip portion 824 spans across the recessed cavity 817. The bridge grip portion 824 can at least partially define the user interface 819 for the user to grasp when engaging the container 802. Note that, in one example, the handle 816 can be formed integrally with the first sidewall 810*a*, as well as the recessed portion 815 being formed integrally with the first sidewall 810*a*. This provides a more robust handle 816 for supporting the weight of the container 802 and the objects therein. However, this is not intended to be limiting in any way as the handle 816 can comprise separate components that are coupled or attached to the first sidewall 810*a*, such as via one or more fasteners. Note that the face 812 of the container 802 can comprise a curved surface profile or configuration, and the container 802 can be generally wedded shaped. In other examples, the container 802 can be any other suitable shape and size to support contents therein.

Figure 16A:
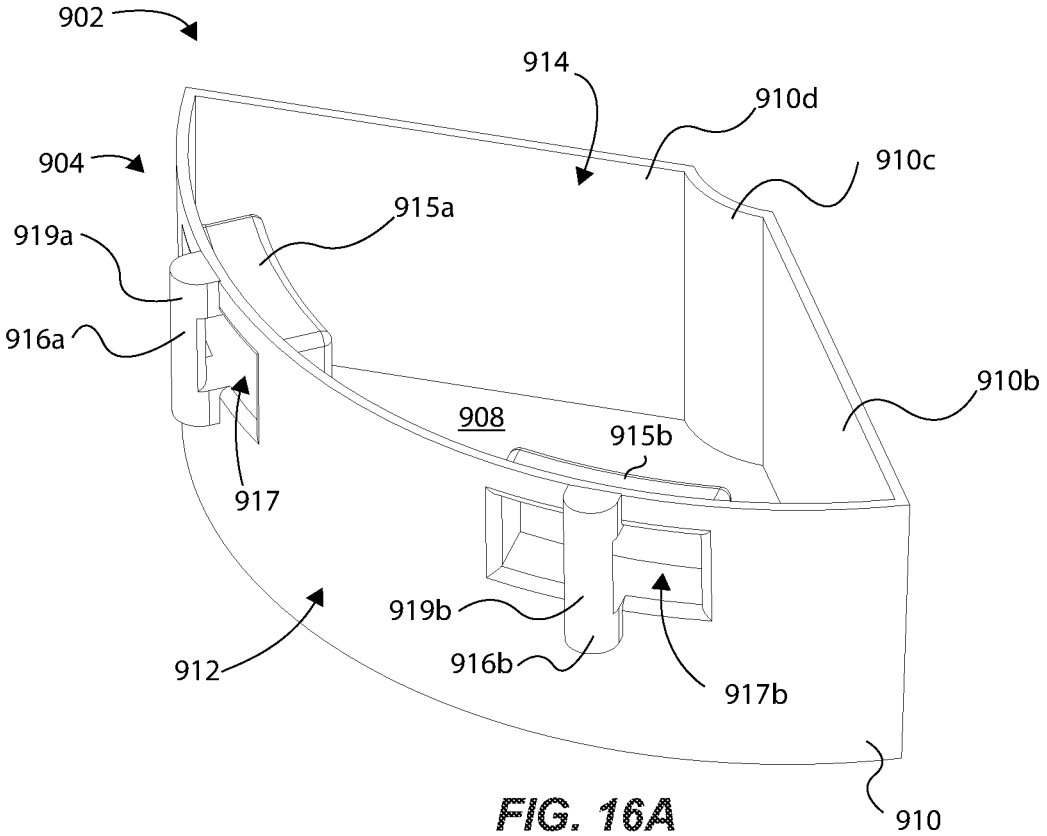
FIG. 16A is an isometric view of a container having low-profile handles and usable with the container dispenser assembly of FIG. 10, in accordance with an example of the present disclosure.
Figure 16B:
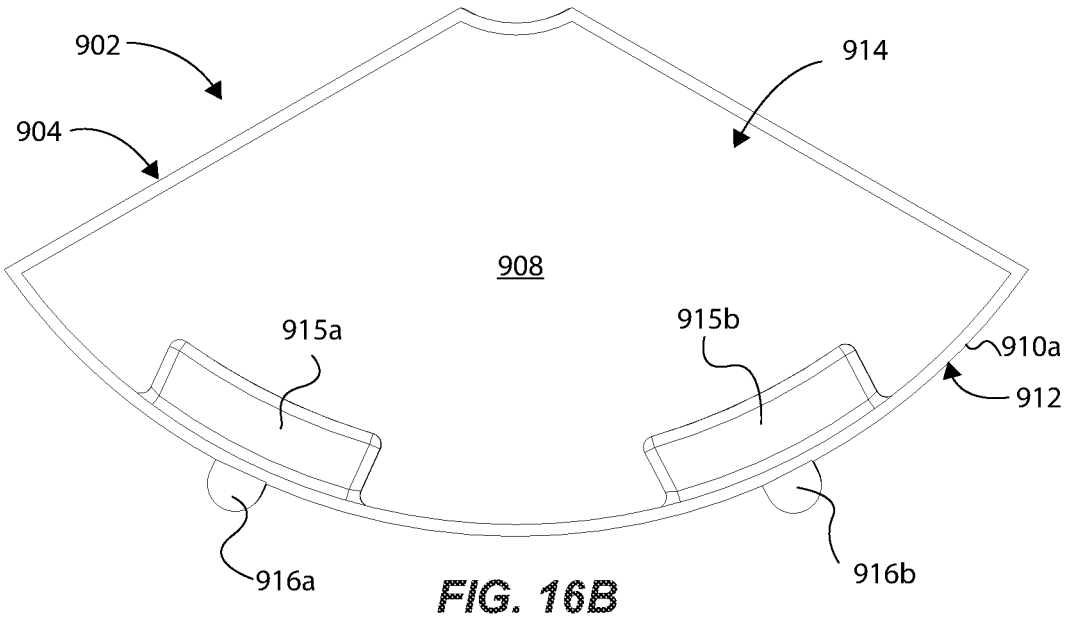
FIG. 16B is top view of the container of FIG. 16A.

FIGS. 16A and 16B illustrate a container 902, in accordance with an example of the present disclosure. The container 902 can comprise a container body 904 for receiving and supporting at least one object. The container body 904 can be formed (e.g., machined, molded, printed, or otherwise formed) of a unitary piece of material, such as constructed of suitable plastics, polymers, metals, composites, etc. The container body 904 can comprise a base 908, and a plurality of sidewalls 910*a-d* extending upward from the base 908 to define an interior volume 914 for supporting object(s). The container body 904 can comprise first and second recessed portions 915*a* and 915*b* formed through a first sidewall 910*a* of the plurality of sidewalls 910*a-d*. The recessed portions 915*a* and 915*b* can extend inward from a face 912 of the first sidewall 910*a* toward a central area of the inner volume 914.

The recessed portions 915*a* and 915*b* can each define a recessed cavity 917*a* and 917*b* defined by sidewalls of the respective recessed portions 915*a* and 915*b*. The container body 904 can further comprise first and second handles 916*a* and 916*b* each supported by the first sidewall 910*a* and extending outward from the face 912 of the first sidewall 910*a*. In this manner, the handles 916*a* and 916*b* (or at least a portion of the handles) can span or extend across the respective recessed cavity 917*a* and 917*b*. Thus, the handles 916*a* and 916*b* each provide a user interface 919*a* and 919*b* for a user to grasp, and the recessed cavities 917*a* and 917*b* each facilitate clearance of at least one finger of the user upon engaging the respective handles 916*a* and 916*b* with two hands.

Indeed, the recessed cavities 917*a* and 917*b* are each large enough for the user to insert one or more fingers into the recessed cavities 917*a* and 917*b* and behind the handles 916*a* and 916*b*. Note that the handles 916*a* and 916*b* provide a low-profile configuration that slightly extends outwardly from the face 912, and that can be similarly formed and shaped as the handle 816 discussed above. Providing two handles 916*a* and 916*b* in this manner may be beneficial for a user to use two hands to lift the container 902 via the handles 916*a* and 916*b* in scenarios where a relatively large weight is supported by the container 902.

Figure 17:
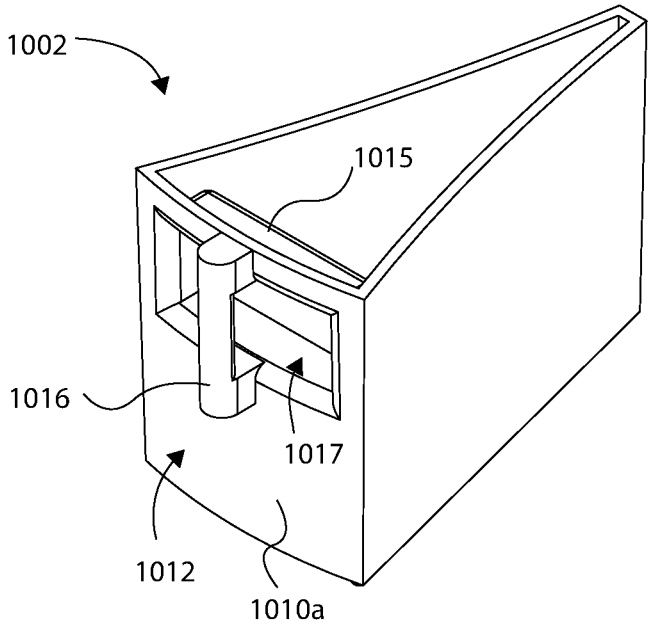
FIG. 17 is an isometric view of a container having a low-profile handle and usable with the container dispenser assembly of FIG. 10, in accordance with an example of the present disclosure.

FIG. 17 illustrates a container 1002, in accordance with an example of the present disclosure. The container 1002 can comprise a recessed portion 1015 formed through a first sidewall 1010*a*, and that can extend inward from a face 1012 of the first sidewall 1010*a* toward an inner volume of the container 1002. The recessed portion 1015 can define a recessed cavity 1017 defined by sidewalls of the recessed portion 1015. A handle 1016 can be supported by the first sidewall 1010*a* and can extend outward from the face 1012 of the first sidewall 1010*a*, such that the handle 1016 spans across the recessed cavity 1017. Thus, the handle 1016 provides a user interface for a user to grasp, and the recessed cavity 1017 facilitates clearance of at least one finger of the user upon grasping the handle 1016. Note that the handle 1016 provides a low-profile configuration that slightly extends outwardly from the face 1012, and that can be similarly formed and shaped as the handle 816 discussed above. Further note that the container 1002 can be a smaller wedge shaped container as compared to container 902, and can be similarly shaped as container 102.

Figure 18:
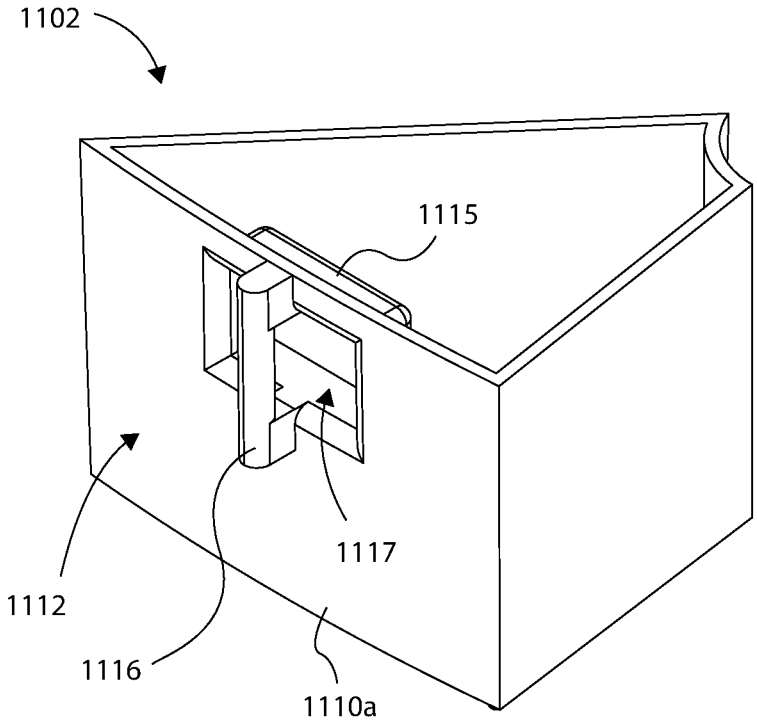
FIG. 18 is an isometric view of a container having a low-profile handle and usable with the container dispenser assembly of FIG. 10, in accordance with an example of the present disclosure.

FIG. 18 illustrates a container 1102, in accordance with an example of the present disclosure. The container 1102 can comprise a recessed portion 1115 formed into a first sidewall 1110*a*, and that can extend inward from a face 1112 of the first sidewall 1110*a* toward an inner volume of the container 1102. The recessed portion 1115 can define a recessed cavity 1117 defined by sidewalls of the recessed portion 1115. A handle 1116 can be supported by the first sidewall 1110*a* and can extend outward from the face 1112 of the first sidewall 1110*a*, such that the handle 1116 spans across the recessed cavity 1117. Thus, the handle 1116 provides a user interface for a user to grasp, and the recessed cavity 1117 facilitates clearance of at least one finger of the user upon grasping the handle 1116. Note that the handle 1116 provides a low-profile configuration that slightly extends outwardly from the face 1112, and that can be similarly formed and shaped as the handle 816 discussed above. Further note that the container 1102 can be a differently shaped and sized container as compared to containers 902 and 1002, and can be similarly shaped as container 302.

Reference was made to the examples illustrated in the drawings and specific language was used herein to describe the same. It will nevertheless be understood that no limitation of the scope of the technology is thereby intended. Alterations and further modifications of the features illustrated herein and additional applications of the examples as illustrated herein are to be considered within the scope of the description.

Although the disclosure may not expressly disclose that some embodiments or features described herein may be combined with other embodiments or features described herein, this disclosure should be read to describe any such combinations that would be practicable by one of ordinary skill in the art. The use of "or" in this disclosure should be understood to mean non-exclusive or, i.e., "and/or," unless otherwise indicated herein.

Furthermore, the described features, structures, or characteristics may be combined in any suitable manner in one or more examples. In the preceding description, numerous specific details were provided, such as examples of various configurations to provide a thorough understanding of examples of the described technology. It will be recognized, however, that the technology may be practiced without one or more of the specific details, or with other methods, components, devices, etc. In other instances, well-known structures or operations are not shown or described in detail to avoid obscuring aspects of the technology.

Although the subject matter has been described in language specific to structural features and/or operations, it is to be understood that the subject matter defined in the appended claims is not necessarily limited to the specific features and operations described above. Rather, the specific features and acts described above are disclosed as example forms of implementing the claims. Numerous modifications and alternative arrangements may be devised without departing from the spirit and scope of the described technology.

What is claimed is:

1. A system for manipulation of a container with a handle attachment tool, the system comprising:

a first container comprising:

a base;

a plurality of sidewalls extending upward from the base, a first of the plurality of sidewalls comprising a face;

an interior volume for supporting at least one object, the interior volume defined, at least in part, by the base and the plurality of sidewalls; and a handle formed outwardly from the face; and a handle attachment tool comprising a body having a first container interface surface, and a slot formed through the first container interface surface and comprising a keyed profile shaped and sized to receive the handle of the first container;

wherein, in response to interfacing the first container interface surface of the handle attachment tool with the face of the first sidewall of the first container and then upwardly moving the handle attachment tool relative to the first container, the keyed profile receives and interfaces with the handle of the first container to lock the handle attachment tool to the first container, and wherein the handle attachment tool comprises a second container interface surface, and a slot formed through the second container interface surface and comprising a keyed profile shaped and sized to receive a handle of a second container.

2. The system of claim 1, wherein the first container interface surface of the handle attachment tool comprises a surface configuration corresponding to a surface configuration of the face of the first container for surface-to-surface contact between the handle attachment tool and the first container to facilitate distribution of one or more loads acting between the handle attachment tool and the first container.

3. The system of claim 1, wherein the handle comprises a T-shaped body corresponding to the keyed profile of the slot of the handle attachment tool, wherein the slot is further formed through an upper surface of the handle attachment tool such that the T-shaped body of the handle operates to slide downwardly into the keyed profile of the slot to lock the handle attachment tool to the first container.

4. The system of claim 1, further comprising the second container, wherein the second container comprises:

a base;

a plurality of sidewalls extending upward from the base, a first of the plurality of sidewalls comprising a face;

an interior volume for supporting at least one object, the interior volume defined, at least in part, by the base and the plurality of sidewalls; and a handle formed outwardly from the face, and operable to interface with the second container interface of the handle attachment tool.

5. The system of claim 4, wherein the face of the second container comprises a surface configuration that corresponds to a surface configuration of the second container interface surface.

* * * * *